US009228279B2

(12) United States Patent
Abe et al.

(10) Patent No.: US 9,228,279 B2
(45) Date of Patent: Jan. 5, 2016

(54) SEWING MACHINE

(71) Applicant: BROTHER KOGYO KABUSHIKI KAISHA, Nagoya-shi, Aichi-ken (JP)

(72) Inventors: Daisuke Abe, Nagoya (JP); Yuki Ihira, Kakamigahara (JP); Yutaka Nomura, Anjo (JP); Hidenori Oka, Tokai (JP); Akie Shimizu, Nagoya (JP); Satoru Ichiyanagi, Nagoya (JP); Manami Ota, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/540,691

(22) Filed: Nov. 13, 2014

(65) Prior Publication Data

US 2015/0152581 A1 Jun. 4, 2015

(30) Foreign Application Priority Data

Nov. 29, 2013 (JP) ..... 2013-246883

(51) Int. Cl.
*D05B 19/08* (2006.01)
*D05B 19/12* (2006.01)

(52) U.S. Cl.
CPC ..... *D05B 19/08* (2013.01); *D05B 19/12* (2013.01)

(58) Field of Classification Search
CPC ..... D05B 19/08; D05B 19/12; D05B 19/14; D05C 5/04; D05C 5/02
See application file for complete search history.

(56) References Cited

U.S. PATENT DOCUMENTS 3,966,331 A * 6/1976 Inuiya ..... G01B 11/002 250/233
4,998,489 A * 3/1991 Hisatake ..... D05B 19/08 112/103
5,072,680 A * 12/1991 Nakashima ..... D05B 79/00 112/445
5,195,451 A * 3/1993 Nakashima ..... D05B 79/00 112/102.5
6,000,350 A * 12/1999 Koike ..... D05B 19/10 112/102.5
6,883,446 B2 * 4/2005 Koerner ..... D05B 19/14 112/272
7,079,917 B2 * 7/2006 Taguchi ..... D05B 19/08 700/138
7,373,891 B2 * 5/2008 Koerner ..... D05B 11/00 112/103
8,061,286 B2 * 11/2011 Hirata ..... D05B 19/10 112/102.5
8,074,590 B2 * 12/2011 Bentley ..... D05B 11/00 112/470.01

(Continued)

FOREIGN PATENT DOCUMENTS

JP A-2-228997 9/1990
JP A-8-294590 11/1996

(Continued)

*Primary Examiner* — Danny Worrell
(74) *Attorney, Agent, or Firm* — Oliff PLC

(57) ABSTRACT

A sewing machine includes a sewing portion, a display, a processor, and a memory. The sewing portion is configured to perform sewing on a sewing workpiece. The memory is configured to store computer-readable instructions. The computer-readable instructions, when executed by the processor, cause the sewing machine to perform processes that include determining a plurality of first positions based on embroidery data, causing the display to display an image showing an embroidery pattern and a plurality of feature points superimposed on the image, identifying one of the plurality of first positions indicated by one of the plurality of feature points displayed on the display, identifying, as a second position, an arbitrary position on the sewing workpiece, changing positions of a plurality of stitches identified by the embroidery data, and causing the sewing portion to sew the plurality of stitches based on the changed positions of the plurality of stitches.

11 Claims, 13 Drawing Sheets

(56) References Cited

U.S. PATENT DOCUMENTS

| | | | | |
|---|---|---|---|---|
| 8,567,329 | B2 * | 10/2013 | Kishi | D05B 19/14 112/470.04 |
| 8,763,542 | B2 * | 7/2014 | Abe | D05B 19/04 112/102.5 |
| 2004/0182295 | A1 * | 9/2004 | Pfeifer | D05B 39/005 112/119 |
| 2006/0096510 | A1 | 5/2006 | Kuki et al. | |
| 2011/0226170 | A1 * | 9/2011 | Tokura | D05C 13/02 112/470.05 |
| 2012/0111249 | A1 * | 5/2012 | Sekine | D05C 5/04 112/102.5 |
| 2012/0210925 | A1 * | 8/2012 | Koga | D05B 19/12 112/470.04 |
| 2013/0233217 | A1 * | 9/2013 | Shimizu | D05C 5/02 112/102.5 |
| 2013/0233218 | A1 | 9/2013 | Nishimura et al. | |
| 2013/0233219 | A1 * | 9/2013 | Nakamura | D05C 5/02 112/470.06 |
| 2013/0233220 | A1 * | 9/2013 | Nomura | D05B 19/12 112/470.06 |
| 2013/0233221 | A1 * | 9/2013 | Abe | D05B 19/12 112/470.06 |
| 2013/0233222 | A1 * | 9/2013 | Nishimura | D05B 19/12 112/470.06 |
| 2014/0000498 | A1 * | 1/2014 | Yamanashi | D05B 19/12 112/102.5 |

FOREIGN PATENT DOCUMENTS

| | | |
|---|---|---|
| JP | A-2006-6977 | 1/2006 |
| JP | A-2006-130124 | 5/2006 |
| JP | A-2013-188266 | 9/2013 |

* cited by examiner

FIG. 4

| No | TYPE | MOVEMENT AMOUNT |
|---|---|---|
| 1 | STITCH | (X1, Y1) |
| 2 | STITCH | (X2, Y2) |
| 3 | FEED | (X3, Y3) |
| 4 | STITCH | (X4, Y4) |
| 5 | STITCH | (X5, Y5) |
| 6 | SUSPENSION | – |
| 7 | STITCH | (X7, Y7) |
| 8 | FEED | (X8, Y8) |
| 9 | STITCH | (X9, Y9) |
| 10 | STITCH | (X10, Y10) |
| 11 | FEED | (X11, Y11) |
| 12 | SUSPENSION | – |
| : | : | : |
| n-1 | FEED | (Xn-1, Yn-1) |
| n | END | – |

FIG. 11

| No | TYPE | COORDINATE DATA |
|---|---|---|
| 1 | BLOCK | (X1, Y1), (X2, Y2), (X3, Y3), (X4, Y4) |
| 2 | BLOCK | (X5, Y5), (X6, Y6), (X7, Y7), (X8, Y8) |
| 3 | BLOCK | (X9, Y9), (X10, Y10), (X11, Y11), (X12, Y12) |
| 4 | BLOCK | (X13, Y13), (X14, Y14), (X15, Y15), (X16, Y16) |
| 5 | SUSPENSION | – |
| 6 | BLOCK | (X17, Y17), (X18, Y18), (X19, Y19), (X20, Y20) |
| 7 | BLOCK | (X21, Y21), (X22, Y22), (X23, Y23), (X24, Y24) |
| 8 | BLOCK | (X25, Y25), (X26, Y26), (X27, Y27), (X28, Y28) |
| : | : | : |
| n | END | – |

SEWING MACHINE

CROSS-REFERENCE TO RELATED APPLICATION

This application claims priority to Japanese Patent Application No. 2013-246883 filed Nov. 29, 2013, the content of which is hereby incorporated herein by reference.

BACKGROUND

The present disclosure relates to a sewing machine that is configured to sew stitches that represent an embroidery pattern.

Sewing machines are known that can easily set positions at which stitches that represent an embroidery pattern are to be sewn on a sewing workpiece that is held by an embroidery frame. For example, a known sewing machine can focus a spot light on a work cloth. The sewing machine can set a position of the spot light (an image focus position) as a position at which stitches that represent an embroidery pattern are to be sewn. More specifically, this sewing machine computes coordinates of the positions of the stitches that represent the embroidery pattern such that a position of a center point matches the image focus position of the spot light. The center point is a point that is computed based on embroidery data that is used to sew the stitches that represent the embroidery pattern.

SUMMARY

With the above-described sewing machine, the position of the center point with respect to the embroidery pattern is computed and set based on the embroidery data. Accordingly, the position of the center point cannot be changed to a position that is desired by a user. Therefore, even if the user specifies the image focus position of the spot light on the work cloth, there is a case in which the positions at which the stitches that represent the embroidery pattern are to be sewn are not set to positions desired by the user. In this case, the user needs to adjust the image focus position of the spot light as necessary, such that the stitches that represent the embroidery pattern are set to the desired positions.

Embodiments of the broad principles derived herein provide a sewing machine that can accurately set positions at which stitches that represent an embroidery pattern are to be sewn to positions desired by a user.

Embodiments provide a sewing machine that includes a sewing portion, a display, a processor, and a memory. The sewing portion is configured to perform sewing on a sewing workpiece. The display is configured to display information. The information includes an image. The memory is configured to store computer-readable instruction. The computer-readable instructions, when executed by the processor, cause the sewing machine to perform processes that includes determining a plurality of first positions based on embroidery data, the plurality of first positions indicating a plurality of positions with respect to an embroidery pattern, and the embroidery data identifying positions of a plurality of stitches that represent the embroidery pattern, causing the display to display an image showing the embroidery pattern and a plurality of feature points superimposed on the image, and the plurality of feature points being marks that respectively indicate the determined plurality of first positions, identifying one of the plurality of first positions indicated by one of the plurality of feature points displayed on the display, identifying, as a second position, an arbitrary position on the sewing workpiece, changing the positions of the plurality of stitches identified by the embroidery data, by aligning the identified one of the plurality of first positions with the identified second position, and causing the sewing portion to sew on the sewing workpiece the plurality of stitches that represent the embroidery pattern, based on the changed positions of the plurality of stitches.

BRIEF DESCRIPTION OF THE DRAWINGS

Embodiments will be described below in detail with reference to the accompanying drawings in which:

FIG. 4 is an explanatory diagram of embroidery data;

FIG. 11 is an explanatory diagram of embroidery data;

DETAILED DESCRIPTION

An embodiment will be explained with reference to the drawings.

Figure 1:
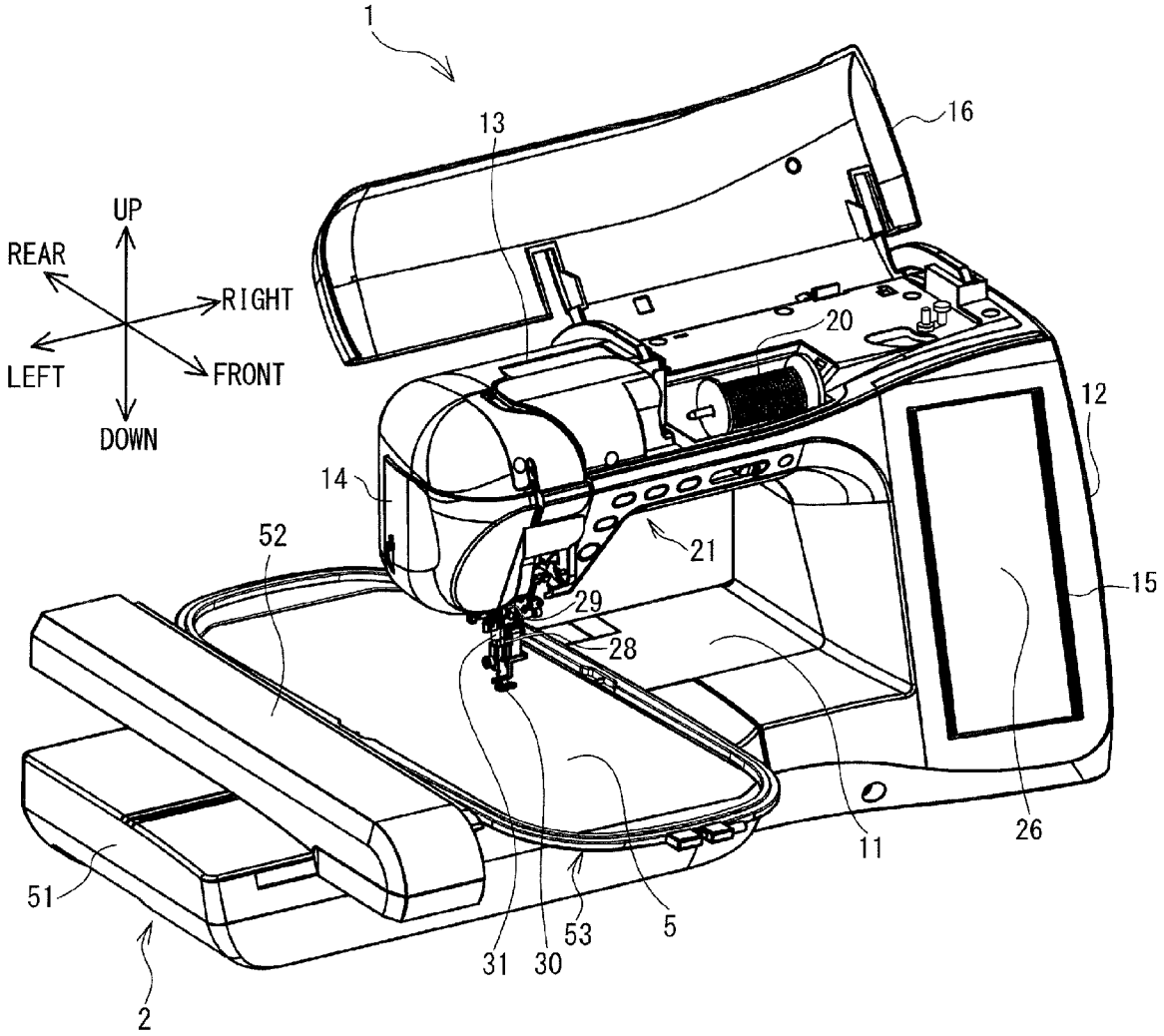
FIG. 1 is a perspective view of a sewing machine and an embroidery frame.
Figure 2:
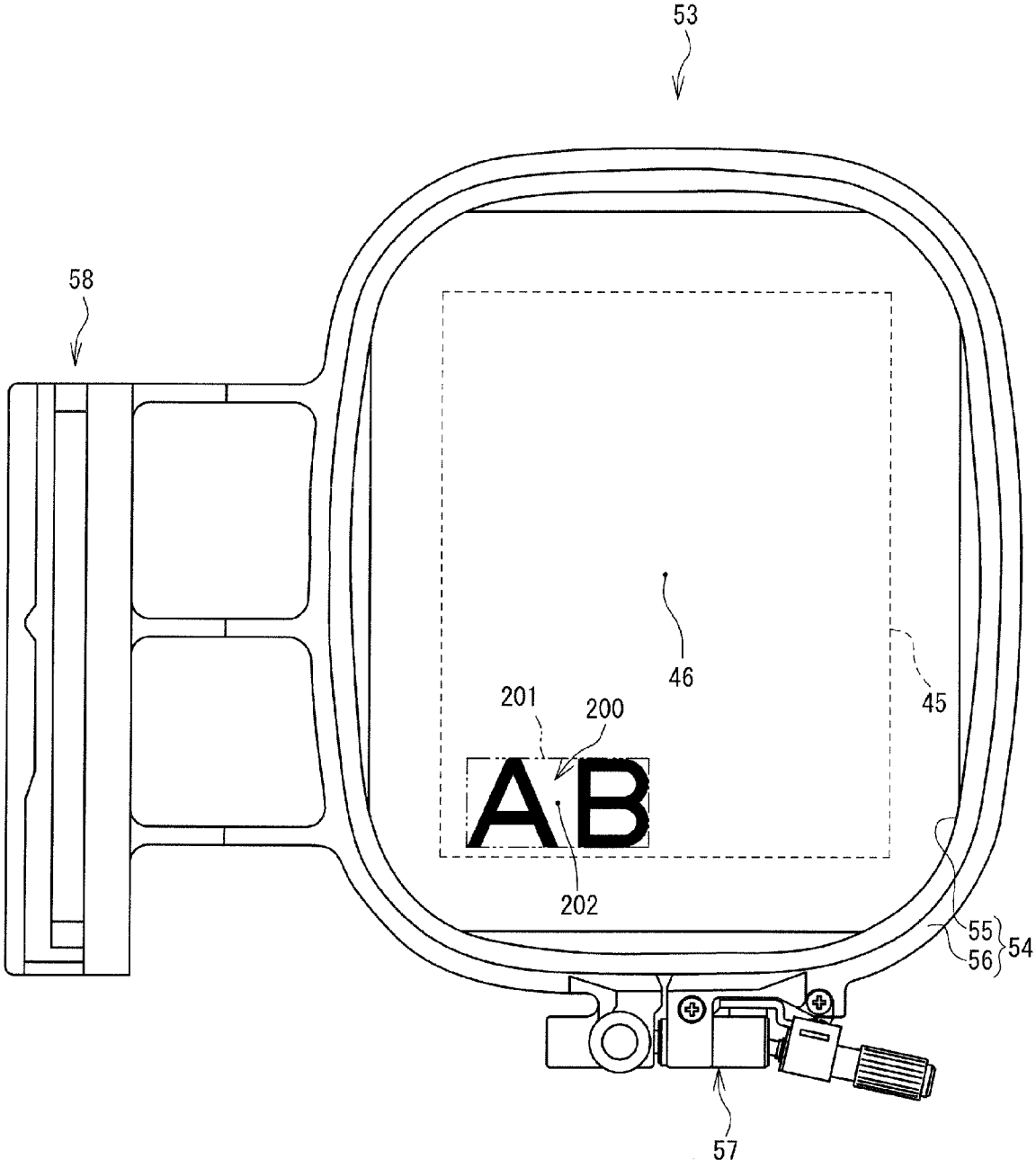
FIG. 2 is a plan view of the embroidery frame.

A configuration of a sewing machine 1 will be explained with reference to FIGS. 1 and 2. The top, the bottom, the lower left, the upper right, the upper left, and the lower right of FIG. 1 respectively correspond to the top, the bottom, the left, the right, the rear, and the front of the sewing machine 1. The sewing machine 1 is configured to sew an embroidery pattern. As shown in FIG. 1, the sewing machine 1 includes a bed 11, a pillar 12, and an arm 13. The bed 11 is a base portion of the sewing machine 1 and extends in the left-right direction. The pillar 12 extends upward from the right end portion of the bed 11. The arm 13 extends to the left from the upper end portion of the pillar 12, facing the bed 11. The left end portion of the arm 13 is a head 14.

A needle plate (not shown in the drawings) is disposed on the top surface of the bed 11. A feed dog (not shown in the drawings), a feed mechanism 85 (refer to FIG. 3), a feed motor 80 (refer to FIG. 3), and a shuttle mechanism (not shown in the drawings) are provided below the needle plate, namely, inside the bed 11. The feed dog is driven by the feed mechanism 85. The feed dog is configured to feed a sewing workpiece in a predetermined feed direction (the front-rear direction of the sewing machine 1). The sewing workpiece may, for example, be a work cloth. The feed mechanism 85 is a mechanism that drives the feed dog to move in the up-down direction and the front-rear direction. A bobbin around which a lower thread is wound can be accommodated within the shuttle mechanism. The shuttle mechanism is a mechanism that is configured to sew a stitch on the sewing workpiece in cooperation with a sewing needle 28 that is mounted on the lower end of a needle bar 29, which will be described below. The feed motor 80 is a pulse motor that drives the feed mechanism 85.

A known embroidery unit 2 can be mounted on and removed from the bed 11. The embroidery unit 2 is used to sew the embroidery pattern. When the embroidery unit 2 is mounted on the sewing machine 1, the embroidery unit 2 and the sewing machine 1 are electrically connected. The embroidery unit 2 is configured to move a sewing workpiece 5 that is held by an embroidery frame 53. The embroidery unit 2 includes a main body portion 51 and carriage 52.

The carriage 52 is provided above the main body portion 51. The carriage 52 has a substantially rectangular parallelepiped shape that is long in the front-rear direction. The carriage 52 includes a frame holder (not shown in the drawings), a Y axis moving mechanism 88 (refer to FIG. 3), and a Y axis motor 83 (refer to FIG. 3). The embroidery frame 53 can be mounted on or removed from the frame holder. A plurality of embroidery frames that are different in at least one of size and shape may be prepared as the embroidery frame 53. The frame holder is provided on the right side surface of the carriage 52. The sewing workpiece 5 that is held by the embroidery frame 53 may be disposed above the bed 11 and below a needle bar 29 and a presser foot 30. The Y axis moving mechanism 88 is configured to move the frame holder in the front-rear direction (a Y axis direction). By the frame holder being moved in the front-rear direction, the embroidery frame 53 may move the sewing workpiece 5 in the front-rear direction. The Y axis motor 83 drives the Y axis moving mechanism 88. A CPU 61 (refer to FIG. 3) of the sewing machine 1 controls the Y axis motor 83 in accordance with embroidery data, which is described below.

Figure 3:
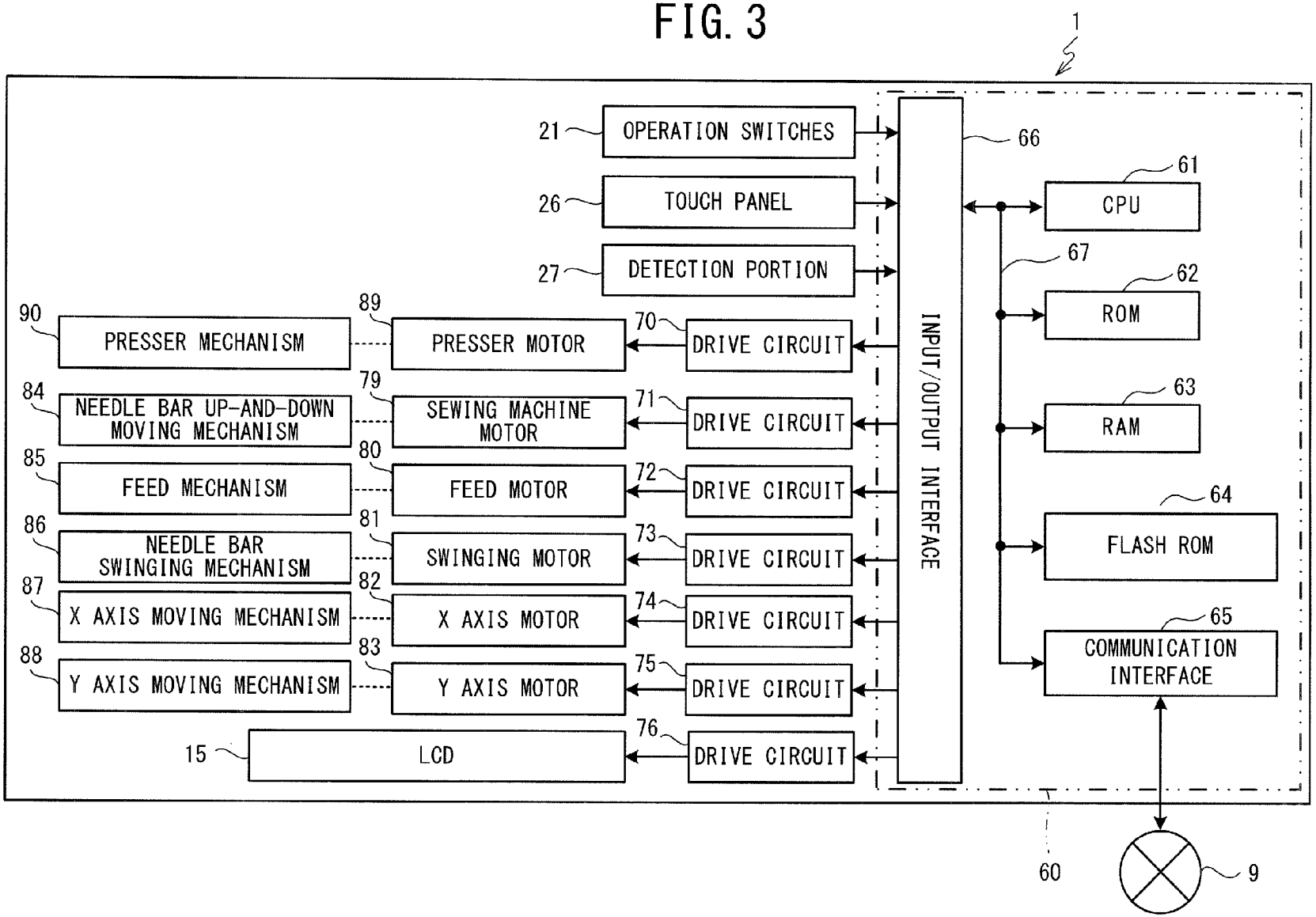
FIG. 3 is a block diagram showing an electrical configuration of the sewing machine.

The main body portion 51 internally includes an X axis moving mechanism 87 (refer to FIG. 3) and an X axis motor 82 (refer to FIG. 3). The X axis moving mechanism 87 is configured to move the carriage 52 in the left-right direction (an X axis direction). By the carriage 52 being moved in the left-right direction, the embroidery frame 53 may move the sewing workpiece 5 in the left-right direction. The X axis motor 82 drives the X axis moving mechanism 87. The CPU 61 of the sewing machine 1 controls the X axis motor 82 in accordance with the embroidery data, which is described below.

The liquid crystal display (LCD) 15 is provided on the front surface of the pillar 12. An image including various items, such as a command, an illustration, a setting value, a message, etc., may be displayed on the LCD 15. A touch panel 26 is provided on the front surface side of the LCD 15. The touch panel 26 is configured to detect a pressed position. When the user performs a pressing operation on the touch panel 26 using the user's finger or a stylus pen (not shown in the drawings), the pressed position may be detected by the touch panel 26. An item selected on the image may be recognized based on the detected pressed position. Hereinafter, the pressing operation on the touch panel 26 by the user is referred to as a panel operation. By the panel operation, the user may select a pattern that the user desires to sew or may select a command to be executed.

A connector (not shown in the drawings) is provided on a right side surface of the pillar 12. The sewing machine 1 can be connected to an external device via the connector. Examples of the external device include a personal computer (PC), an imaging device, and a mobile terminal.

A cover 16 that can be opened and closed is provided on an upper portion of the arm 13. FIG. 1 shows the cover 16 in an opened state. A thread spool 20 may be accommodated underneath the cover 16, that is, substantially in the center of the interior of the arm 13. A sewing thread (not shown in the drawings) that is wound around the thread spool 20 is supplied to the sewing needle 28 mounted on the needle bar 29, via a thread guide portion (not shown in the drawings) that is provided in the head 14. A plurality of operation switches 21 are provided in a lower portion of the front face of the arm 13. The plurality of operation switches 21 include a start/stop switch.

A presser mechanism 90 (refer to FIG. 3), a needle bar up-and-down moving mechanism 84 (refer to FIG. 3), a needle bar swinging mechanism 86 (refer to FIG. 3), a swinging motor 81 (refer to FIG. 3), and the like are provided inside the head 14. The presser mechanism 90 is configured to drive a presser bar 31, using a presser motor 89 (refer to FIG. 3) as a driving source. The needle bar up-and-down moving mechanism 84 is configured to drive the needle bar 29 in the up-down direction in accordance with rotation of a drive shaft (not shown in the drawings). The needle bar up-and-down moving mechanism 84 is driven by a sewing machine motor 79 (refer to FIG. 3). The needle bar 29 and the presser bar 31 extend downward from a lower end portion of the head 14. The sewing needle 28 can be attached to and detached from the lower end of the needle bar 29. The presser foot 30 can be attached to and detached from the lower end of the presser bar 31. The presser foot 30 can press against the sewing workpiece 5 from above such that the sewing workpiece 5 can be moved. The needle bar swinging mechanism 86 is configured to swing the needle bar 29 in a direction (the left-right direction) that is orthogonal to the direction (the front-rear direction) in which the sewing workpiece 5 is fed by the feed dog. The swinging motor 81 is a pulse motor that drives the needle bar swinging mechanism 86.

In the sewing machine 1, when a stitch is sewn using the embroidery unit 2, the embroidery frame 53 is moved to a needle drop point, which is indicated by an embroidery coordinate system, by the Y axis moving mechanism 88 and the X axis moving mechanism 87. The embroidery coordinate system is a coordinate system that is unique to the sewing machine 1. The embroidery coordinate system is a coordinate system of the X axis motor 82 and the Y axis motor 83, which move the carriage 52. In the present embodiment, the embroidery coordinate system is defined as follows. The left-right direction of the sewing machine 1 is the X direction. The direction from the left to the right is the X axis plus direction. The front-rear direction of the sewing machine 1 is the Y direction. The direction from the front to the rear is the Y axis plus direction. The needle drop point is a point at which the sewing needle 28 that is disposed vertically above a needle hole (not shown in the drawings) pierces the sewing workpiece 5 when the needle bar 29 is moved downward from above the sewing workpiece 5. In conjunction with the movement of the embroidery frame 53, the shuttle mechanism (not shown in the drawings) and the needle bar 29 to which the sewing needle 28 is attached are driven. Thus, stitches that represent a pattern may be sewn on the sewing workpiece 5. The X axis motor 82, the Y axis motor 83, the sewing machine motor 79, and the like are controlled by the CPU 61 (which will be described below), which is built into the sewing machine 1, based on embroidery data, which will be described below. When a normal utility stitch, which is not an embroidery pattern, is sewn, the embroidery unit 2 may be removed from the bed 11. In this state, the sewing may be performed while a sewing workpiece is fed by the feed dog (not shown in the drawings).

A physical configuration of the embroidery frame 53 will be explained with reference to FIG. 2. As shown in FIG. 2, the embroidery frame 53 includes a mounting portion 58 and a clamping portion 54. The embroidery unit 2 includes the frame holder (not shown in the drawings). The mounting portion 58 may be detachably mounted on the frame holder of the embroidery unit 2 that is mounted on the sewing machine 1. The clamping portion 54 includes a first frame 55 and a second frame 56. The clamping portion 54 is configured such that the first frame 55 and the second frame 56 clamp the sewing workpiece 5. The first frame 55 and the second frame 56 are each a substantially rectangular frame-shaped member whose longer axis extends in the front-rear direction and whose corners are rounded. The inner circumferential shape of the second frame 56 is substantially identical to the outer circumferential shape of the first frame 55. The first frame 55 is configured to fit into and removed from the second frame 56. A parting portion 57 is provided on the front side of the second frame 56. The parting portion 57 divides the second frame 56 in a central portion in a direction in which the front side of the second frame 56 extends. A tightening mechanism is provided in the parting portion 57. The tightening mechanism is configured to tighten the second frame 56 with respect to the first frame 55. The sewing workpiece 5 may be clamped between the first frame 55 and the second frame 56 and may be held in a taut state by the tightening mechanism. A sewing area 45 is set within the first frame 55. The sewing area 45 is an area in which a stitch can be sewn by the sewing machine 1. The sewing area 45 varies depending on the type of the embroidery frame 53. A center point 46 is a position of a center of gravity of the sewing area 45.

An electrical configuration of the sewing machine 1 will be explained with reference to FIG. 3. A control portion 60 of the sewing machine 1 includes the CPU 61, a ROM 62, a RAM 63, a flash ROM 64, a communication interface 65, and an input/output interface 66. The CPU 61, the ROM 62, the RAM 63, the flash ROM 64, the communication interface 65, and the input/output interface 66 are mutually electrically connected via a bus 67. The ROM 62 stores various programs including a program for the CPU 61 to perform main processing, which will be described below, data, etc. The flash ROM 64 stores a plurality of sets of embroidery data and the like. The communication interface 65 is an interface element to connect the sewing machine 1 to a network 9.

The operation switches 21, the touch panel 26, a detection portion 27, and drive circuits 70 to 76 are electrically connected to the input/output interface 66. The detection portion 27 may detect whether or not the embroidery frame 53 is mounted on the embroidery unit 2. Further, the detection portion 27 may detect the type of the embroidery frame 53 mounted on the embroidery unit 2. The detection portion 27 outputs a detection result to the CPU 61 via the input/output interface 66. The drive circuits 70 to 76 drive the presser motor 89, the sewing machine motor 79, the feed motor 80, the swinging motor 81, the X axis motor 82, the Y axis motor 83, and the LCD 15, respectively.

The embroidery data will be explained taking an embroidery pattern 200 shown in FIG. 2 as an example. Hereinafter, the embroidery pattern 200 is simply referred to as the pattern 200. The left-right direction and the up-down direction of FIG. 2 respectively correspond to the X direction and the Y direction of the embroidery coordinate system. The pattern 200 is a pattern that represents the capital letters "A" and "B" of the alphabet. The letters "A" and "B" are arranged side by side in the lateral direction.

FIG. 4 shows an example of the embroidery data to sew stitches that represent the pattern 200. Hereinafter, the stitches that represent the pattern 200 are simply referred to as the stitches of the pattern 200. The embroidery data includes various types of data, such as stitch data, feed data, suspension data and end data. Depending on an embroidery pattern, the embroidery data may not include the feed data and the suspension data. In the stitch data and the feed data, an index is associated with movement amount data. The index indicates a sewing order. The movement amount data indicates a relative movement amount of the embroidery frame 53 in each of the X direction and the Y direction. More specifically, the stitch data indicates a movement amount by which the embroidery frame 53 is moved to sew the stitches of the pattern 200. The feed data indicates a movement amount when the embroidery frame 53 is moved a relatively large distance without sewing the stitches of the pattern 200. In the suspension data, the index is associated with data that indicates suspension of a sewing operation. The sewing operation is suspended in order to change stitch colors (exchange the thread spool 20). In the end data, the index is associated with data that indicates an end of the sewing operation. As shown in FIG. 4, a plurality of sets of the stitch data, a plurality of sets of the feed data, a plurality of sets of the suspension data, and the end data are arranged in the sewing order when the stitches of the pattern 200 are sewn, namely, in an index order.

Hereinafter, the stitch data, the feed data, the suspension data and the end data are collectively referred to as control data. The movement amount that is indicated by the movement amount data included in the stitch data is simply referred to as a movement amount of the stitch data. The movement amount that is indicated by the movement amount data included in the feed data is simply referred to as a movement amount of the feed data.

The position that is used as a reference for the movement amount of the stitch data and the movement amount of the feed data is a position of a center of gravity of a minimum rectangle 201 (refer to FIG. 2) that encompasses the pattern 200. Hereinafter, the position of the center of gravity of the minimum rectangle 201 that encompasses the pattern 200 is referred to as a center point 202 (refer to FIG. 2) of the pattern 200. The origin (Xi, Yi) (=(0, 0)) of the embroidery coordinate system is a position at which the center point 46 (refer to FIG. 2) of the sewing workpiece 5 matches a needle drop point. In other words, the movement amount of the stitch data or the feed data for which the index is smallest among the plurality of sets of control data indicates a movement amount in each of the X direction and the Y direction when the embroidery frame 53 is moved from a state in which the needle drop point is arranged at the center point 46 of the sewing workpiece 5. The position that is used as a reference for the movement amount of the stitch data and the movement amount of the feed data from a second movement onward is indicated by a value that is obtained by adding movement amounts of all the stitch data and the feed data up to the respective immediately preceding data, in each of the X direction and the Y direction. The position of the embroidery frame 5 when the needle drop point is arranged at the center point 46 of the sewing workpiece 5 is referred to as an initial position.

The CPU 61 acquires the plurality of sets of control data included in the embroidery data from the flash ROM 64 in the index order, and performs processing corresponding to the type of each set of the control data. In this manner, the sewing machine 1 can sew the stitches of the pattern 200 on the sewing workpiece 5. For example, when the stitch data is acquired, the CPU 61 drives the X axis motor 82 and the Y axis motor 83 based on the movement amount data included in the stitch data, and moves the embroidery frame 53 using the embroidery unit 2. At the same time, the CPU 61 uses the sewing machine motor 79 to drive the needle bar up-and-down moving mechanism 84, and causes the needle bar 29 to which the sewing needle 28 has been attached to move up and down. In this manner, the sewing machine 1 sews the stitches on the sewing workpiece 5. When the feed data is acquired, the CPU 61 drives the X axis motor 82 and the Y axis motor 83 based on the movement amount data included in the feed data, and moves the embroidery frame 53 using the embroidery unit 2. In the case of the feed data, as described above, the stitches are not sewn on the sewing workpiece 5. Therefore, the CPU 61 stops the driving of the sewing machine motor 79. When the suspension data is acquired, the CPU 61 stops the acquisition of the next control data. In this manner, the CPU 61 stops the driving of the sewing machine motor 79, and also stops the movement of the embroidery frame 53 by the embroidery unit 2. After that, if necessary, the CPU 61 causes the LCD 15 to display a screen that prompts the user to replace the thread spool 20 with the thread spool 20 around which a specified color of sewing thread is wound. The user may replace the thread spool 20, if necessary. The user may perform a panel operation to command the restart of the sewing. When the panel operation is detected, the CPU 61 acquires the next control data and restarts the processing. When the end data is acquired, the CPU 61 ends the sewing.

When the above-described processing is performed based on the embroidery data, the stitches of the pattern 200 are sewn such that the center point 202 (refer to FIG. 2) of the pattern 200 matches the center point 46 (refer to FIG. 2) of the sewing workpiece 5. In contrast to this, with the sewing machine 1 of the present embodiment, the user may specify an arbitrary position on the sewing workpiece 5 and a particular position within the pattern 200. The CPU 61 changes the embroidery data such that the two positions specified by the user match each other, and thus creates data to sew the stitches of the pattern 200 on the sewing workpiece 5. Hereinafter, the data created by changing the embroidery data is referred to as changed data. A plurality of particular positions within the pattern 200, which are extracted to allow the user to select one of the plurality of particular positions, are referred to as a plurality of first positions. An arbitrary position on the sewing workpiece 5 that is specified by the user is referred to as a second position.

Figure 5:
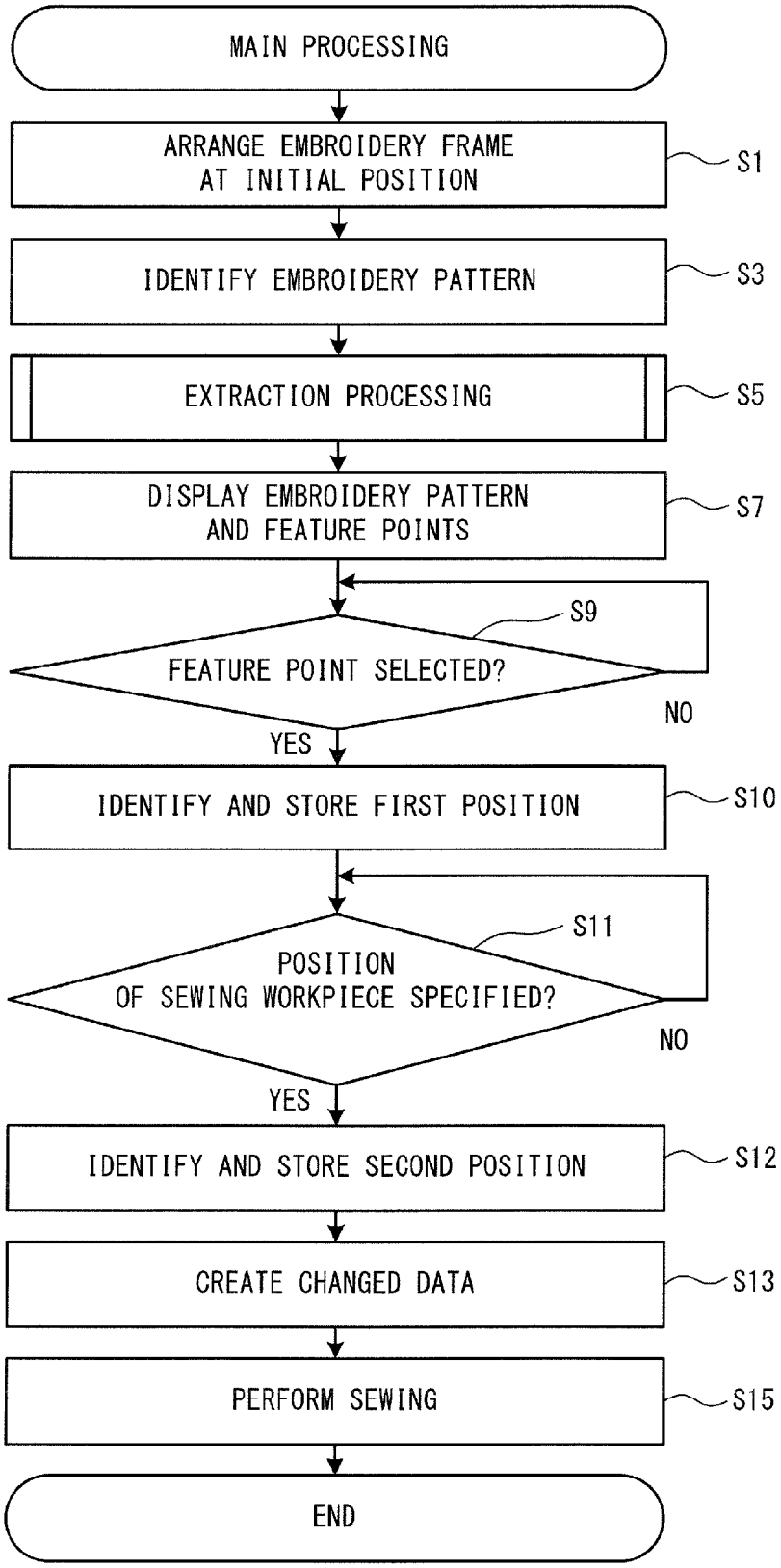
FIG. 5 is a flowchart of main processing.
Figure 6:
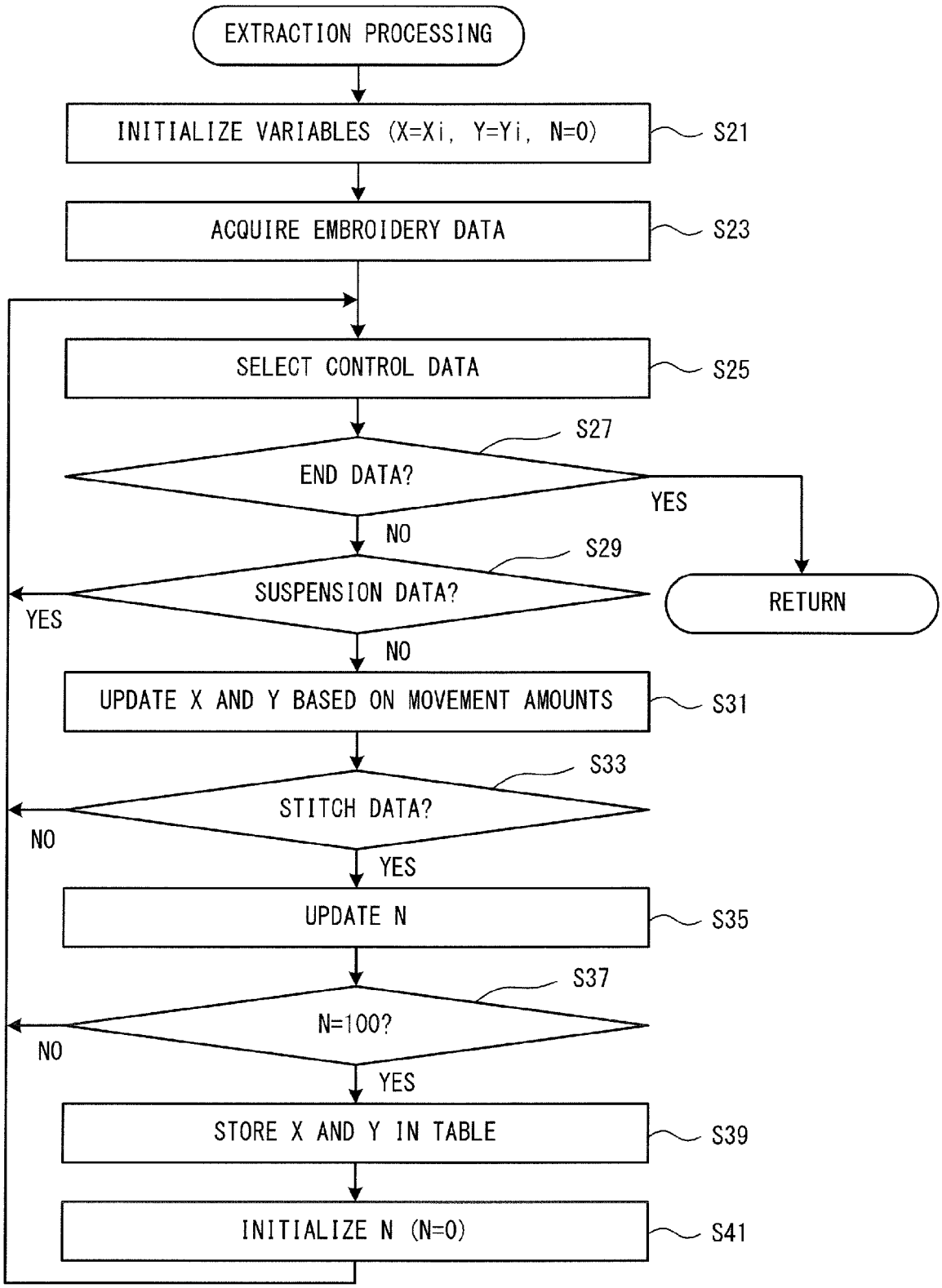
FIG. 6 is a flowchart of extraction processing.

The main processing will be explained with reference to FIGS. 5 and 6. When the user performs a panel operation to start the sewing of stitches that represent an embroidery pattern, the main processing is started by the CPU 61 executing the program stored in the ROM 62. As shown in FIG. 5, first, the CPU 61 causes the position of the embroidery frame 53 to be arranged at the initial position (step S1). Specifically, the CPU 61 drives the X axis motor 82 and the Y axis motor 83 and moves the embroidery frame 53 using the embroidery unit 2. By doing this, the center point 46 (refer to FIG. 2) of the sewing workpiece 5 held by the embroidery frame 53 is arranged at the needle drop point.

As described above, the plurality of sets of embroidery data are stored in the flash ROM 64. The CPU 61 causes the LCD 15 to display a screen on which one of a plurality of embroidery patterns that respectively correspond to the plurality of sets of embroidery data can be selected. The user may perform a panel operation to select a desired one of the embroidery patterns. The CPU 61 detects the panel operation and identifies the selected embroidery pattern (step S3). Hereinafter, a specific explanation will be given using an example in which the pattern 200 (refer to FIG. 2) is identified at step S3. Next, the CPU 61 performs processing (extraction processing, refer to FIG. 6) that extracts the plurality of first positions based on the embroidery data that corresponds to the pattern 200 identified at step S3 (step S5).

The extraction processing will be explained with reference to FIG. 6. In the extraction processing, variables X, Y, and N that are stored in the RAM 63, and a table that defines the plurality of first positions are used. First, the CPU 61 initializes the variables X, Y, and N (step S21). Specifically, the CPU 61 sets the variable X to the X coordinate Xi (=0) of the origin, sets the variable Y to the Y coordinate Yi (=0) of the origin, and sets the variable N to 0. Next, the CPU 61 reads and acquires, from the flash ROM 64, the embroidery data to sew the stitches of the pattern 200 identified at step S3 (refer to FIG. 5) (step S23). The CPU 61 may acquire the embroidery data using a method other than that described above. For example, the CPU 61 may acquire the embroidery data via the network 9 that is connected to the communication interface 65 (refer to FIG. 3). The CPU 61 may acquire an embroidery pattern via the network 9 that is connected to the communication interface 65, and may create the embroidery data to sew stitches that represent the acquired embroidery pattern.

From among the plurality of sets of control data included in the acquired embroidery data, the CPU 61 selects the control data one set at a time in ascending order of the index (step S25). Based on the type of the selected control data, the CPU 61 determines whether or not the selected control data is the end data (step S27). When it is determined that the selected control data is not the end data (no at step S27), the CPU 61 determines whether or not the selected control data is the suspension data (step S29). When it is determined that the selected control data is the suspension data (yes at step S29), the CPU 61 returns the processing to step S25.

When the CPU 61 determines that the selected control data is not the suspension data (no at step S29), the selected control data is the stitch data or the feed data. Therefore, the selected control data includes the movement amount data. The CPU 61 adds the movement amount in the X direction of the movement amount data included in the selected control data to the variable X, and adds the movement amount in the Y direction to the variable Y. In this manner, the CPU 61 updates the variables X and Y (step S31). The CPU 61 determines whether or not the selected control data is the stitch data (step S33). When it is determined that the selected control data is not the stitch data (no at step S33), the CPU 61 returns the processing to step S25.

When it is determined that the selected control data is the stitch data (yes at step S33), the CPU 61 adds 1 to the variable N and updates the variable N (step S35). The CPU 61 determines whether or not the variable N is 100 (step S37). When it is determined that the variable N is not 100 (no at step S37), the CPU 61 returns the processing to step S25. When it is determined that the variable N is 100 (yes at step S37), the CPU 61 stores, in the table, the coordinates (X, Y) that are indicated by the variables X and Y, as one of the plurality of first positions, and thus updates the table (step S39). In other words, the coordinates (X, Y) that are stored in the table are each an accumulated value of movement amounts of the stitch data for which the variable N is 1 to 100 and movement amounts of the feed data up to the data immediately preceding the stitch data for which the variable N is 100. Next, the CPU 61 sets the variable N to 0 and thus initializes the variable N (step S41), and returns the processing to step S25. When it is determined that the selected control data is the end data (yes at step S27), the CPU 61 ends the extraction processing and returns the processing to the main processing (refer to FIG. 5). When the processing returns to step S25 from one of the steps S29, S33, S37, and S41, the CPU 61 selects the control data of the next index and performs the processing in the same manner as described above.

In the above description, the explanation is given using the example in which the extraction processing is performed based on the embroidery data that includes the stitch data and the feed data. In contrast to this, for example, when the extraction processing is performed based on the embroidery data that includes the stitch data and does not include the feed data, the coordinates (X, Y) that are stored in the table at step S39 are each an accumulated value of the movement amounts of the stitch data for which the variable N is 1 to 100.

As shown in FIG. 5, after the extraction processing (step S5) is completed, the CPU 61 causes the LCD 15 to display an image that shows the pattern 200 identified at step S3 (step S7). The image that shows the pattern 200 may be formed based on the embroidery data that corresponds to the pattern 200. In this case, the CPU 61 may create the image that shows the pattern 200 based on the embroidery data acquired at step S23 (refer to FIG. 6), and causes the LCD 15 to display the image. The image that shows the pattern 200 may be stored in the flash ROM 64 in advance in association with the embroidery data. In this case, the CPU 61 reads and acquires, from the flash ROM 64, the image that shows the pattern 200 identified at step S3, and causes the LCD 15 to display the image.

Using the embroidery coordinate system, the CPU 61 identifies positions of a plurality of pixels that form the image that shows the pattern 200 displayed on the LCD 15, based on the embroidery data corresponding to the pattern 200. The CPU 61 identifies the plurality of first positions based on the table stored in the RAM 63. The CPU 61 superimposes a plurality of feature points 206 (refer to FIG. 7), which are shown by a design that will be described below, on positions corresponding to the plurality of first positions, among the positions of the plurality of pixels that form the image that shows the pattern 200 displayed on the LCD 15, and causes the LCD 15 to display the feature points 206 (step S7).

Figure 7:
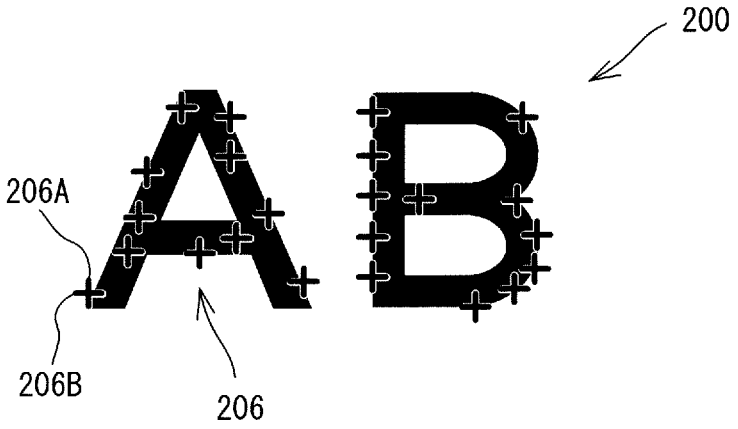
FIG. 7 is a diagram showing an embroidery pattern and a plurality of feature points that are displayed on a liquid crystal display.

The image that shows the pattern 200 and the plurality of feature points 206 will be explained with reference to FIG. 7. The plurality of feature points 206 are marks that are arranged at the positions corresponding to the plurality of first positions, among the positions of the plurality of pixels that form the image that shows the pattern 200. Each of the plurality of feature points 206 includes a first line segment 206A, which extends in the Y direction, and a second line segment 206B, which extends in the X direction. The first line segment 206A and the second line segment 206B are orthogonal to each other. The first line segment 206A and the second line segment 206B intersect with each other at a position at which each of the line segments is divided into two equal parts in the length direction. The length of the first line segment 206A is the same as the length of the second line segment 206B. The position of the intersection point of the first line segment 206A and the second line segment 206B indicates the first position.

The design of each of the plurality of feature points 206 is not limited to the above-described example, and may be another design that can be distinguished from the image that shows the pattern 200. For example, each of the plurality of feature points 206 may include a first line segment that is inclined at 45 degrees with respect to the X direction, and a second line segment that is orthogonal to the first line segment. Further, for example, each of the plurality of feature points 206 may be a design of a circle or a polygon.

As shown in FIG. 5, the CPU 61 causes the LCD 15 to display the plurality of feature points 206 such that the plurality of feature points 206 are superimposed on the image that shows the pattern 200 (step S7). After that, the CPU 61 determines whether or not a panel operation to select one of the plurality of feature points 206 displayed on the LCD 15 is detected (step S9). When the user selects one of the plurality of feature points 206, the user may touch a position, on the touch panel 26, that corresponds to one of the plurality of feature points 206 displayed on the LCD 15. When it is determined that the panel operation to select one of the plurality of feature points 206 is not detected (no at step S9), the CPU 61 returns the processing to step S9. When it is determined that the panel operation to select one of the plurality of feature points 206 is detected (yes at step S9), the CPU 61 identifies coordinates that indicate the first position that corresponds to the selected feature point 206, based on the table stored in the RAM 63, and stores the identified coordinates in the RAM 63 (step S10). The CPU 61 advances the processing to step S11.

The operation to select one of the plurality of feature points 206 displayed on the LCD 15 is not limited to the above-described method. For example, a cursor may be superimposed on one of the plurality of feature points 206 and displayed on the LCD 15. Further, direction keys to change the position of the cursor and a decision key may be displayed on the LCD 15. In this case, the user may use the direction keys to move the cursor and to superimpose the cursor on one of the plurality of feature points 206. Then, the user may select one of the plurality of feature points 206 by touching a position that corresponds to the decision key on the touch panel 26.

When the panel operation to select one of the plurality of feature points 206 is detected, next, the CPU 61 causes the LCD 15 to display direction keys to move the embroidery frame 53 and a decision key. By using the direction keys and the decision key, the user may specify, for the sewing machine 1, a position on the sewing workpiece 5 at which the stitches of the pattern 200 are to be sewn. Specifically, this is performed as follows. The user may move the embroidery frame 53 by touching a position that corresponds to the direction key on the touch panel 26. Thus, the user may arrange the position on the sewing workpiece 5 at which the stitches of the pattern 200 are to be sewn, at a position that is vertically below the sewing needle 28 attached to the lower end of the needle bar 29. By touching the position that corresponds to the decision key on the touch panel 26, the user may ascertain the position on the sewing workpiece 5 at which the stitches of the pattern 200 are to be sewn.

When the panel operation on the direction keys is detected, the CPU 61 drives the X axis motor 82 and the Y axis motor 83 in accordance with the detected panel operation, and moves the embroidery frame 53 using the embroidery unit 2. The CPU 61 determines whether or not the panel operation on the decision key is detected (step S11). When it is determined that the panel operation on the decision key is not detected (no at step S11), the CPU 61 returns the processing to step S11. When it is determined that the panel operation on the decision key is detected (yes at step S11), the CPU 61 identifies the movement amount in the X direction and the movement amount in the Y direction from the initial position of the embroidery frame 53, based on drive amounts of the X axis motor 82 and the Y axis motor 83 that are driven in accordance with the panel operation on the direction keys. The CPU 61 identifies the identified movement amount in the X direction and the identified movement amount in the Y direction, as the coordinates that indicate the position of the sewing workpiece 5 specified by the user, namely, as the coordinates that indicate the second position, and stores the coordinates in the RAM 63 (step S12). The CPU 61 advances the processing to step S13.

The operation to specify, for the sewing machine 1, the position on the sewing workpiece 5 at which the stitches of the pattern 200 are to be sewn is not limited to the above-described method. For example, the user may use a known laser pointer to irradiate a laser beam onto the position on the sewing workpiece 5 at which the stitches of the pattern 200 are to be sewn. In this case, for example, the CPU 61 may perform image processing based on an image of the sewing workpiece 5 captured by a camera (not shown in the drawings), and thus may identify the position of the sewing workpiece 5 onto which the laser beam has been irradiated. The CPU 61 may identify, as the origin, the position vertically below the sewing needle 28 attached to the lower end of the needle bar 29, in other words, the position of the center point 46 of the sewing workpiece 5 held by the embroidery frame 53 arranged at the initial position. The CPU 61 may identify, as the second position, the position onto which the laser beam is irradiated with respect to the origin.

For example, the user may attach a predetermined marker to the position of the sewing workpiece 5 at which the stitches of the pattern 200 are to be sewn. In this case, for example, the CPU 61 may perform image processing based on the image of the sewing workpiece 5 captured by the camera. The CPU 61 may use the image processing to identify the position of the sewing workpiece 5 to which the predetermined marker has been attached. The CPU 61 may identify, as the second position, the position to which the predetermined marker has been attached with respect to the origin.

For example, the user may use an ultrasonic pen that can output an ultrasonic wave. Specifically, this is performed as follows. The ultrasonic pen is configured to output an ultrasonic wave when its leading end is pressed. The user may use the leading end of the ultrasonic pen to press the position on the sewing workpiece 5 at which the stitches of the pattern 200 are to be sewn. The ultrasonic pen outputs an ultrasonic wave. Ultrasonic sensors (not shown in the drawings) can detect the ultrasonic wave. The CPU 61 acquires, from each of the ultrasonic sensors, a timing at which the ultrasonic wave is detected. Based on the timing at which the ultrasonic wave is acquired from each of the ultrasonic sensors, the CPU 61 identifies the position on the sewing workpiece 5 pressed by the leading end of the ultrasonic pen. The CPU 61 may identify, as the second position, the position pressed by the leading end of the ultrasonic pen with respect to the origin.

Based on the first position identified at step S10 and the second position identified at step S12, the CPU 61 changes the embroidery data that corresponds to the pattern 200 selected at step S3, and creates second changed data (step S13). Specifically, this is performed as follows. The embroidery data corresponding to the pattern 200 selected at step S3 is data to sew the stitches of the pattern 200 such that the center point 202 of the pattern 200 matches the center point 46 of the sewing workpiece 5. First, the CPU 61 subtracts the X coordinate of the first position from the movement amount in the X direction of the stitch data or the feed data for which the index is smallest among the plurality of sets of control data included in the embroidery data. Further, the CPU 61 subtracts the Y coordinate of the first position from the movement amount in the Y direction of the stitch data or the feed data for which the index is smallest. Thus, the embroidery data is changed to data to sew the stitches of the pattern 200 such that the first position matches the center point 46 of the sewing workpiece 5. Hereinafter, the data to sew the stitches of the pattern 200 such that the first position matches the center point 46 of the sewing workpiece 5 is referred to as first changed data.

Next, the CPU 61 subtracts the X coordinate of the second position from the movement amount in the X direction of the stitch data or the feed data for which the index is smallest among the plurality of sets of control data included in the first changed data. Further, the CPU 61 subtracts the Y coordinate of the second position from the movement amount in the Y direction of the stitch data or the feed data for which the index is smallest. Thus, the first changed data is changed to data to sew the stitches of the pattern 200 such that the first position matches the second position. Hereinafter, the data to sew the stitches of the pattern 200 such that the first position matches the second position is referred to as the second changed data. The CPU 61 stores the created second changed data in the RAM 63.

The CPU 61 acquires the plurality of sets of control data included in the second changed data stored in the RAM 63, in the index order, and performs processing corresponding to the type of each set of the control data. Thus, the stitches of the pattern 200 are sewn on the sewing workpiece 5 (step S15). When the CPU 61 acquires the end data, all the stitches that represent the embroidery pattern have been sewn. Therefore, the CPU 61 ends the main processing.

As explained above, the CPU 61 of the sewing machine 1 extracts the plurality of first positions that are a plurality of positions with respect to the pattern 200, based on the embroidery data (step S5). From among the plurality of feature points 206, which are marks arranged at the extracted plurality of first positions, the CPU 61 detects the feature point 206 selected by the user (yes at step S9). The CPU 61 identifies the first position that corresponds to the feature point 206 (step S10). When the panel operation to move the embroidery frame 53 is performed by the user (yes at step S11), the CPU 61 identifies the second position based on the movement amount in the X direction and the movement amount in the Y direction with respect to the initial position of the embroidery frame 53 (step S12). By changing the embroidery data, the CPU 61 creates the second changed data to sew the stitches of the pattern 200 such that the first position matches the second position (step S13). The CPU 61 performs the processing based on the created second changed data, and thus sews the stitches of the pattern 200 on the sewing workpiece 5 (step S15).

In this manner, the user may specify, for the sewing machine 1, one of the plurality of feature points 206 and a desired position on the sewing workpiece 5. It is thus possible to cause the sewing machine 1 to sew the stitches of the pattern 200 such that the position of the selected feature point 206 matches the desired position on the sewing workpiece 5. In addition to the desired position (the second position) on the sewing workpiece 5, the user may specify a particular position (the first position) with respect to the pattern 200. Thus, the positions of the stitches of the pattern 200 to be sewn on the sewing workpiece 5 can be specified in detail for the sewing machine 1. The sewing machine 1 can accurately set the positions of the stitches of the pattern 200 to the positions on the sewing workpiece 5 desired by the user, and can sew the stitches.

The CPU 61 identifies positions of the stitches to be sewn based on 100n-th stitch data (where n is an integer greater than 1), among the plurality of sets of control data that are arranged in the sewing order. The CPU 61 stores the identified positions in the table as the plurality of first positions (step S39). The CPU 61 superimposes, on the pattern 200, marks that are respectively arranged at the plurality of first positions stored in the table, and displays the marks on the LCD 15 as the plurality of feature points 206 (step S7). The user may select one of the plurality of feature points 206. The CPU 61 can set, as the plurality of first positions, the positions of the stitches to be sewn based on a plurality of sets the stitch data that are selected for each predetermined number of stitches in the sewing order, from among all the stitch data. Therefore, the CPU 61 can uniformly disperse and arrange the plurality of first positions with respect to the pattern 200.

The CPU 61 causes the LCD 15 to display the image that shows the pattern 200 and the plurality of feature points 206, and allows the user to select one of the plurality of feature points 206. The user may select one of the plurality of feature points 206, and thus may specify a particular position with respect to the pattern 200 for the sewing machine 1. Therefore, the CPU 61 can improve convenience when the user specifies the particular position with respect to the pattern 200 for the sewing machine 1.

When the CPU 61 performs the extraction processing (step S5), the CPU 61 extracts the plurality of first positions based on the plurality of sets of control data included in the embroidery data. When the CPU 61 extracts the plurality of first positions, the CPU 61 does not need to use data other than the plurality of sets of control data. Therefore, the CPU 61 can easily extract the plurality of first positions.

The CPU 61 can cause the LCD 15 to display the plurality of feature points 206 in a form in which the plurality of feature points 206 can be distinguished from the image that shows the pattern 200 (step S7). Therefore, the user can appropriately recognize the plurality of feature points 206 displayed on the LCD 15 by distinguishing the plurality of feature points 206 from the image that shows the pattern 200. Thus, the user can appropriately select a desired one of the feature points 206. The CPU 61 represents each of the plurality of feature points 206 using the first line segment 206A and the second line segment 206B, which are arranged orthogonally to each other. The coordinates indicating each of the plurality of first positions that correspond to the plurality of feature points 206 are shown by the intersection point between the first line segment 206A and the second line segment 206B. Therefore, the user can accurately recognize the positions of the plurality of feature points 206 displayed on the LCD 15.

Various modifications can be made to the above-described embodiment. The structure of the sewing machine 1 may be changed as appropriate. A multi-needle sewing machine may be used. A sewing machine that is structured integrally with an embroidery unit may be used. Any sewing workpiece may be used as long as a stitch can be sewn thereon. The format of the embroidery data is not limited to that of the above-described embodiment. For example, the stitch data may include an absolute position of a needle drop position in the embroidery coordinate system. For example, the feed data may include an absolute position, in the embroidery coordinate system, of the position to which the embroidery frame 53 is to be moved. The threshold value that is compared with the value of the variable N at step S37 of the above-described extraction processing (refer to FIG. 6) may be a value other than 100. The CPU 61 may set a value that is input by a panel operation by the user, as the threshold value that is compared with the value of the variable N.

When the absolute position of the needle drop position in the embroidery coordinate system is included in the stitch data, the CPU 61 may extract the plurality of first positions based only on the stitch data in the extraction processing.

The extraction processing (refer to FIG. 6) and the main processing (refer to FIG. 5) are not limited to the above-described embodiment. Hereinafter, modified examples of the extraction processing (a first modified example to a third modified example) will be explained. Further, a modified example of the main processing (a fourth modified example) will be explained.

First Modified Example

Figure 8:
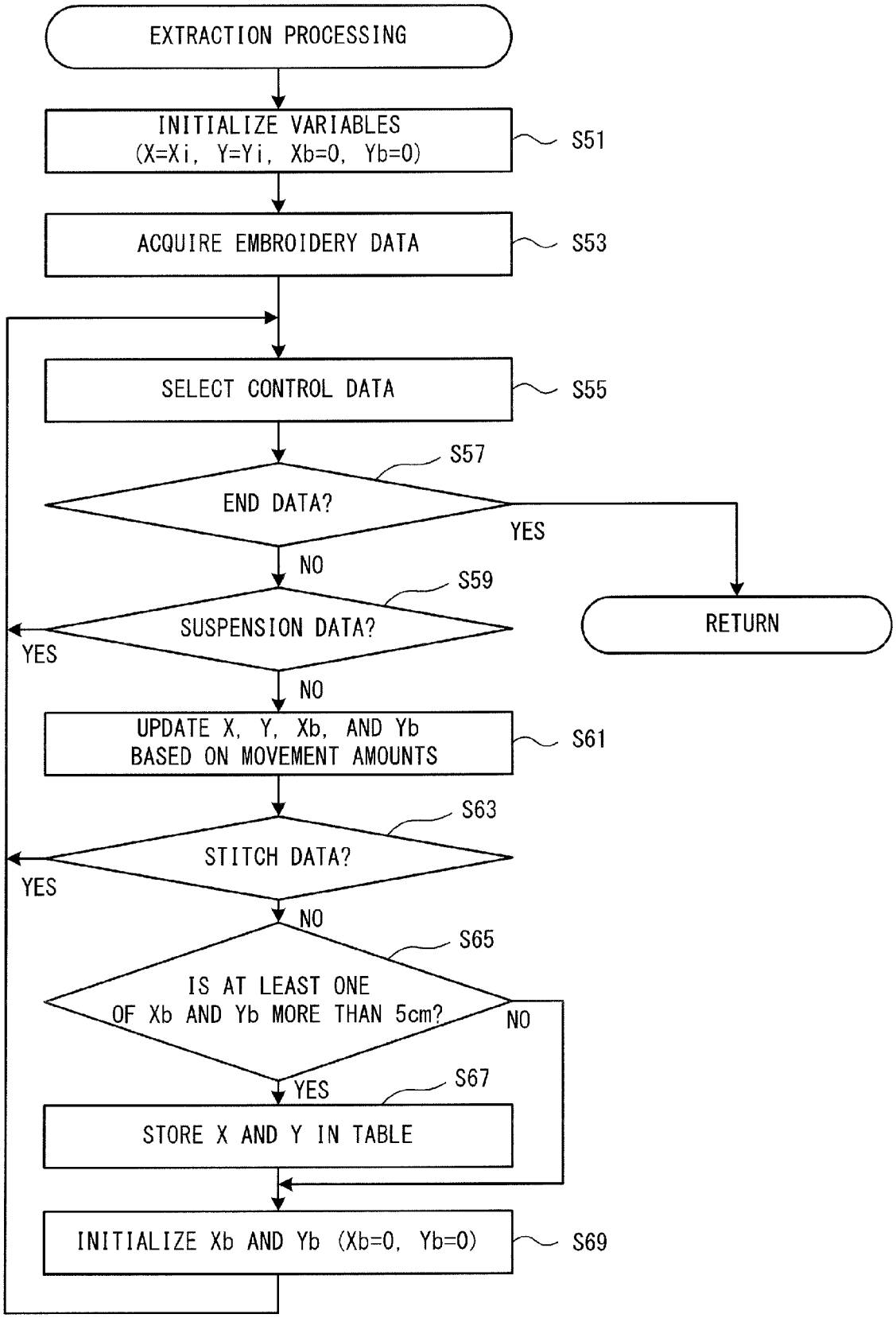
FIG. 8 is a flowchart of extraction processing of a first modified example.

The first modified example of the extraction processing will be explained with reference to FIG. 8. The main processing (refer to FIG. 5) is the same as the above-described embodiment, and an explanation thereof is thus omitted here. The extraction processing in the first modified example is performed at step S5 of the main processing. In the extraction processing, variables X, Y, Xb, and Yb that are stored in the RAM 63, and a table are used.

First, the CPU 61 initializes the variables X, Y, Xb, and Yb (step S51). Specifically, the CPU 61 sets the variable X to the X coordinate Xi (=0) of the origin, sets the variable Y to the Y coordinate Yi (=0) of the origin, and sets the variables Xb and Yb to 0. Next, the CPU 61 reads and acquires the embroidery data from the flash ROM 64 (step S53). From among the plurality of sets of control data included in the acquired embroidery data, the CPU 61 selects the control data one set at a time in ascending order of the index (step S55). The CPU 61 determines whether or not the selected control data is the end data (step S57). When it is determined that the selected control data is not the end data (no at step S57), the CPU 61 determines whether or not the selected control data is the suspension data (step S59). When it is determined that the selected control data is the suspension data (yes at step S59), the CPU 61 returns the processing to step S55.

When the CPU 61 determines that the selected control data is not the suspension data (no at step S59), the selected control data is the stitch data or the feed data. Therefore, the selected control data includes the movement amount data. The CPU 61 adds the movement amount in the X direction of the movement amount data included in the selected control data to the variable X, and adds the movement amount in the Y direction to the variable Y. Further, the CPU 61 sets the movement amount in the X direction as the variable Xb, and sets the movement amount in the Y direction as the variable Yb. In this manner, the CPU 61 updates the variables X, Y, Xb, and Yb (step S61). The CPU 61 determines whether or not the selected control data is the stitch data (step S63). When the CPU 61 determines that the selected control data is the stitch data (yes at step S63), the CPU 61 returns the processing to step S55.

When the CPU 61 determines that the selected control data is not the stitch data (no at step S63), the selected control data is the feed data. The CPU 61 determines whether or not at least one of the variable Xb and the variable Yb is more than 5 cm (step S65). In other words, the CPU 61 determines whether or not the movement amount of the embroidery frame 53 moved based on the feed data is more than 5 cm. When it is determined that at least one of the variable Xb and the variable Yb is larger than 5 cm (yes at step S65), the CPU 61 stores, in the table, the coordinates (X, Y) that are indicated by the variables X and Y, as one of the plurality of first positions, and thus updates the table (step S67). In other words, the coordinates (X, Y) that are stored in the table are each an accumulated value of movement amounts of the plurality of sets of stitch data up to the data immediately preceding the selected feed data, a movement amount of the selected feed data, and movement amounts of the feed data up to the data immediately preceding the selected feed data. Next, the CPU 61 sets each of the variables Xb and Yb to 0 and thus initializes the variables Xb and Yb (step S69). The CPU 61 returns the processing to step S55. When it is determined that the variable Xb is equal to or less than 5 cm and the variable Yb is equal to or less than 5 cm (no at step S65), the CPU 61 sets each of the variables Xb and Yb to 0 and thus initializes the variables Xb and Yb (step S69), and returns the processing to step S55. When the processing returns to step S55 from the processing at one of step S59 and step S69, the CPU 61 selects the control data of the next index and performs the processing in the same manner as described above.

When it is determined that the selected control data is the end data (yes at step S57), the CPU 61 ends the extraction processing and returns the processing to the main processing (refer to FIG. 5). As described above, in the first modified example, the CPU 61 can extract the positions of the stitches for the stitch data immediately following the feed data included in the embroidery data, as the plurality of first positions.

The processing at step S65 of the above-described extraction processing can be changed. For example, the CPU 61 may add the square of the variable Xb and the square of the variable Yb, and may calculate the square root of the added result. When the calculated square root is more than a predetermined value (5 cm, for example), the CPU 61 may update the table by storing, in the table, the coordinates (X, Y) that are indicated by the variables X and Y, as one of the plurality of first positions.

The threshold value that is compared with the values of the variables Xb and Yb in the processing at step S65 maybe a value other than 5 cm. The CPU 61 may use a length that is input by a panel operation by the user, as the threshold value that is compared with the values of the variables Xb and Yb.

In the above-described extraction processing, the CPU 61 extracts the positions of the stitches for the stitch data that immediately follow the feed data, as the plurality of first positions. However, the CPU 61 may extract the positions of the stitches for the stitch data immediately preceding (immediately preceding positions of) the feed data, as the plurality of first positions.

When the absolute position of the needle drop position in the embroidery coordinate system is included in the feed data, the CPU 61 may extract the plurality of first positions based only on the feed data in the extraction processing.

Second Modified Example

Figure 9:
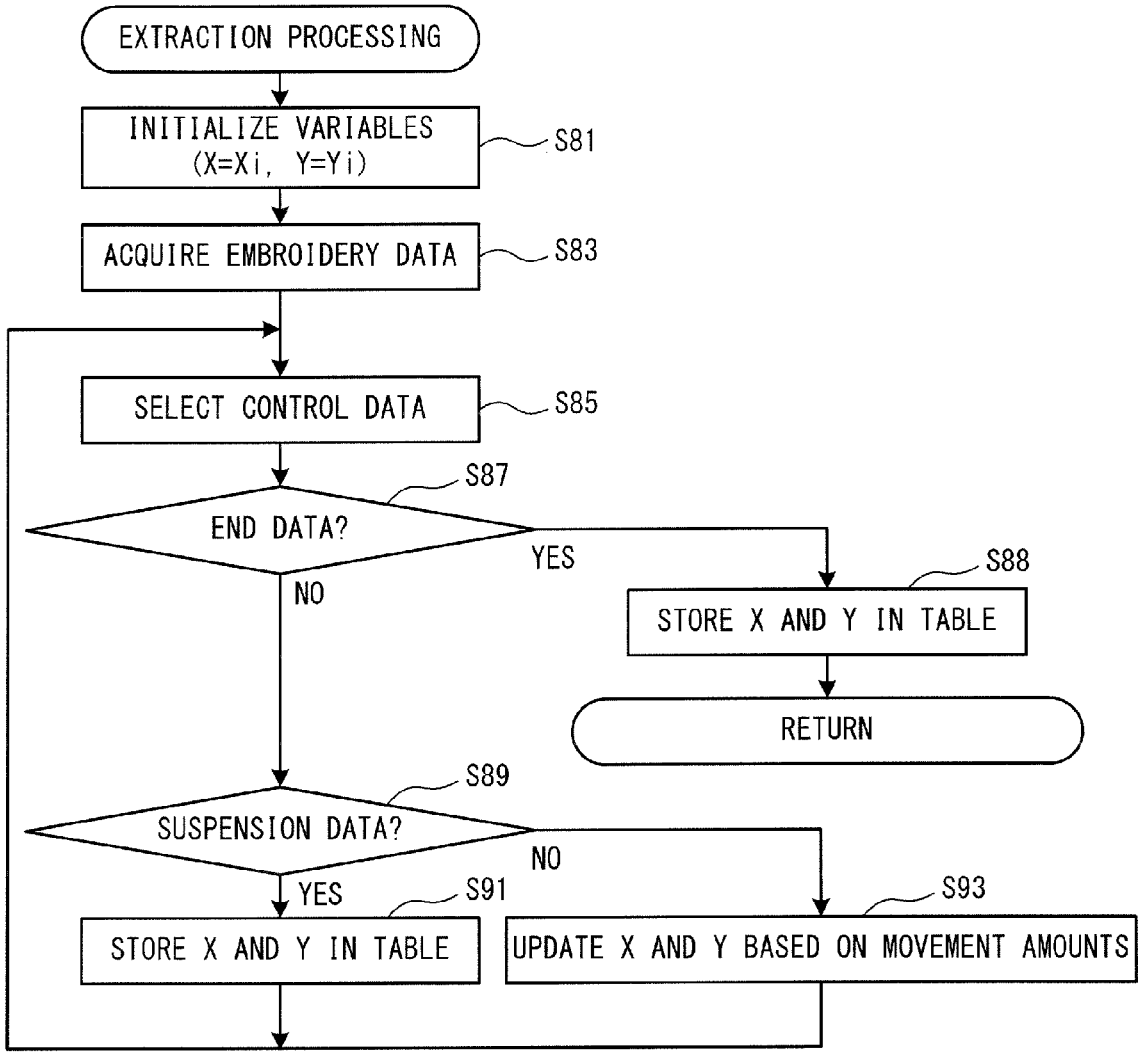
FIG. 9 is a flowchart of extraction processing of a second modified example.

The second modified example of the extraction processing will be explained with reference to FIG. 9. The main processing (refer to FIG. 5) is the same as the above-described embodiment, and an explanation thereof is thus omitted here. The extraction processing in the second modified example is performed at step S5 of the main processing. In the extraction processing, variables X and Y that are stored in the RAM 63, and a table are used.

First, the CPU 61 initializes the variables X and Y (step S81). Specifically, the CPU 61 sets the variable X to the X coordinate Xi (=0) of the origin, and sets the variable Y to the Y coordinate Yi (=0) of the origin. Next, the CPU 61 reads and acquires the embroidery data from the flash ROM 64 (step S83). From among the plurality of sets of control data included in the acquired embroidery data, the CPU 61 selects the control data one set at a time in ascending order of the index (step S85). The CPU 61 determines whether or not the selected control data is the end data (step S87). When it is determined that the selected control data is not the end data (no at step S87), the CPU 61 determines whether or not the selected control data is the suspension data (step S89). When it is determined that the selected control data is the suspension data (yes at step S89), the CPU 61 stores, in the table, the coordinates (X, Y) that are indicated by the variables X and Y, as one of the plurality of first positions, and thus updates the table (step S91). The CPU 61 returns the processing to step S85. On the other hand, when the selected control data is not the suspension data, the selected control data is the stitch data or the feed data. In this case, the selected control data includes the movement amount data. When it is determined that the selected control data is not the suspension data (no at step S89), the CPU 61 adds the movement amount in the X direction to the variable X and adds the movement amount in the Y direction to the variable Y, based on the movement amount data included in the selected control data. In this manner, the CPU 61 updates the variables X and Y (step S93). The CPU 61 returns the processing to step S85.

When it is determined that the selected control data is the end data (yes at step S87), the CPU 61 stores, in the table, the coordinates (X, Y) that are indicated by the variables X and Y, as one of the plurality of first positions, and thus updates the table (step S88). The CPU 61 ends the extraction processing and returns the processing to the main processing (refer to FIG. 5).

As described above, in the second modified example, the CPU 61 stores, in the table, the coordinates that are respectively indicated by the accumulated value of the movement amounts in the X direction and the accumulated value of the movement amounts in the Y direction, up to the suspension data among the plurality of sets of control data arranged in the sewing order, as one of the plurality of first positions (step S91). The suspension data is data to prompt the user to change the sewing thread used to sew stitches. Therefore, the CPU 61 can extract the plurality of first positions for each of colors of sewing threads that are used to sew the stitches of the pattern 200. The CPU 61 can set, as the plurality of first positions, end positions when the stitches are sewn using each of the plurality of sewing threads.

When it is determined that the selected control data is the end data (yes at step S87), the CPU 61 stores, in the table, the coordinates (X, Y) that are indicated by the variables X and Y, as one of the plurality of first positions, and thus updates the table (step S88). In this manner, the CPU 61 can appropriately store, in the table, the first position that corresponds to the color of the sewing thread that is used when the last stitch is sewn. Therefore, the CPU 61 can appropriately extract the plurality of first positions that correspond to the respective colors of the plurality of sewing threads, without omission.

Third Modified Example

Figure 10:
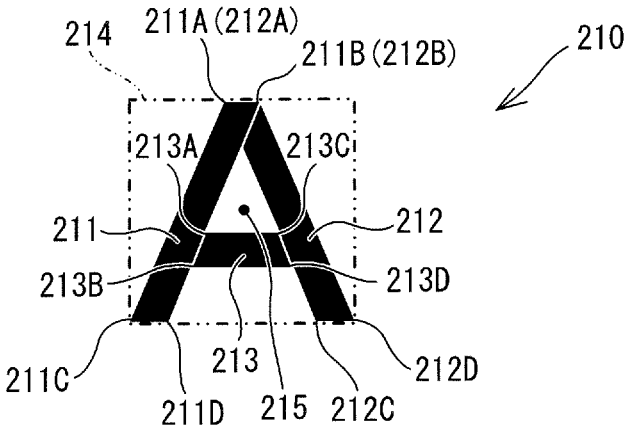
FIG. 10 is an explanatory diagram of an embroidery pattern.
Figure 12:
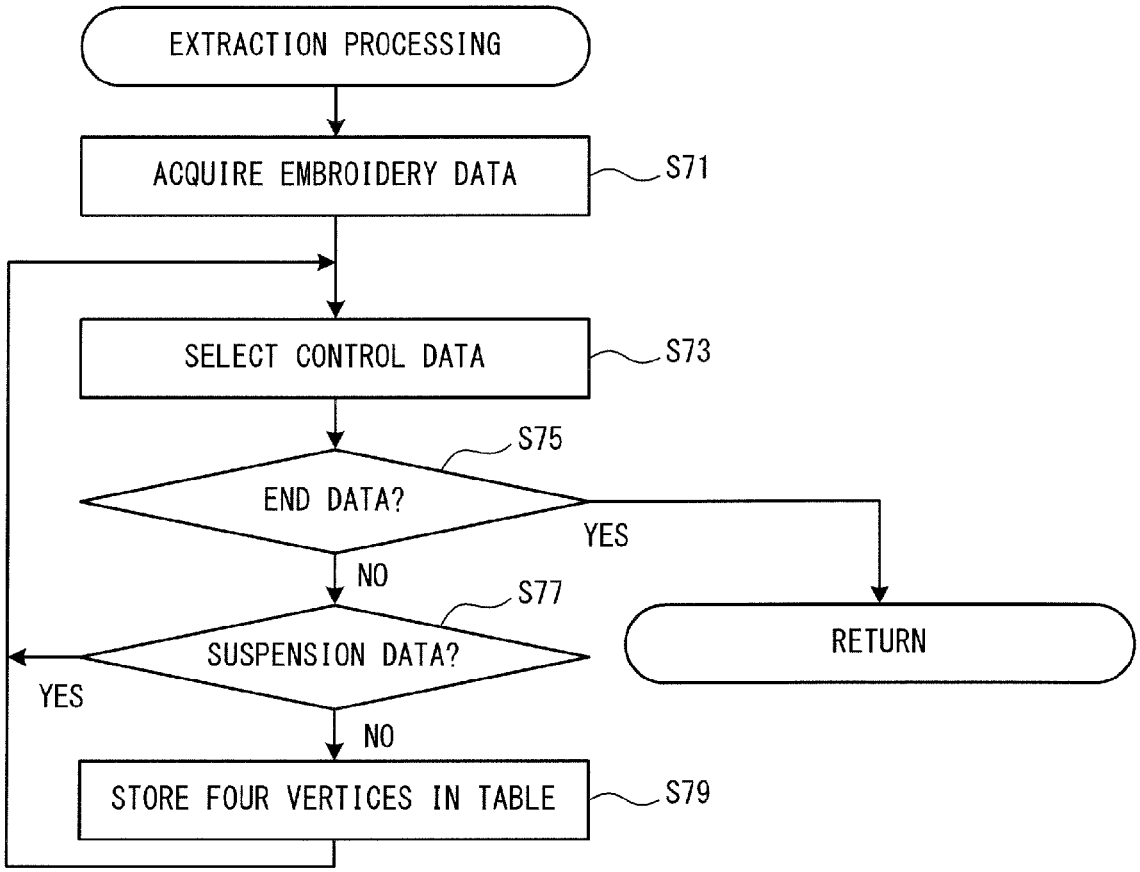
FIG. 12 is a flowchart of extraction processing of a third modified example.

The third modified example of the extraction processing will be explained with reference to FIGS. 10 to 12. In the third modified example, the plurality of first positions are extracted based on embroidery data in a format that is different from the above-described embodiment. The embroidery data will be explained taking an embroidery pattern 210 shown in FIG. 10 as an example. Hereinafter, the embroidery pattern 210 is simply referred to as the pattern 210. The left-right direction and the up-down direction of FIG. 10 respectively correspond to the X direction and the Y direction of the embroidery coordinate system. The pattern 210 is a pattern that represents the capital letter "A" of the alphabet. The pattern 210 is divided into three areas that are shown by blocks 211, 212, and 213. The shape of each of the blocks 211, 212 and 213 is a quadrilateral shape. Each of the blocks 211, 212, and 213 has four vertices. Specifically, the block 211 has four vertices 211A, 211B, 211C, and 211D. The block 212 has four vertices 212A, 212B, 212C, and 212D. The block 213 has four vertices 213A, 213B, 213C, and 213D.

An example of the embroidery data to sew stitches that represent the pattern 210 will be explained with reference to FIG. 11. Hereinafter, the stitches that represent the pattern 210 are simply referred to as the stitches of the pattern 210. The embroidery data includes various types of data, such as block data, suspension data, and end data. In the block data, an index is associated with four sets of vertex data. The index indicates a sewing order. Each of the four sets of vertex data indicates a position of each of the four vertices of the block in the embroidery coordinate system. The position that is used as a reference for each of the four sets of vertex data is a center point 215 (refer to FIG. 10) of a minimum rectangle 214 that encompasses the pattern 210. The suspension data and the end data are the same data as the data included in the embroidery data of the pattern 200. A plurality of sets of the block data, a plurality of sets of the suspension data, and the end data are arranged in the sewing order when the stitches of the pattern 210 are sewn, namely, in an index order. Hereinafter, the plurality of sets of block data, the plurality of sets of suspension data, and the end data are collectively referred to as control data, similarly to the above-described embodiment.

The CPU 61 acquires the plurality of sets of control data included in the embroidery data from the flash ROM 64 in the index order, and performs processing corresponding to the type of each set of the control data. In this manner, the sewing machine 1 sews the stitches of the pattern 210 on the sewing workpiece 5. For example, when the block data is acquired, the CPU 61 identifies the shape of the quadrilateral-shaped block, based on the coordinate data of the four vertices included in the block data. The CPU 61 drives the X axis motor 82 and the Y axis motor 83, and moves the embroidery frame 53 using the embroidery unit 2. At the same time, the CPU 61 uses the sewing machine motor 79 to drive the needle bar up-and-down moving mechanism 84, and causes the needle bar 29 to which the sewing needle 28 is attached to move up and down. Thus, the sewing machine 1 performs sewing on the sewing workpiece 5 clamped in the embroidery frame 53, such that the inside of the block is filled with stitches. The processing that performs sewing such that the inside of the block is filled with stitches is a known technique, and a detailed explanation thereof is therefore omitted here.

When the above-described processing is performed based on the embroidery data, the stitches of the pattern 210 are sewn such that the center point 215 (refer to FIG. 10) of the pattern 210 matches the center point 46 (refer to FIG. 3) of the sewing workpiece 5. In contrast to this, in the sewing machine 1 of the third modified example, the first position and the second position can be specified using the same method as in the above-described embodiment. The CPU 61 extracts a plurality of candidate positions within the minimum rectangle 214 that is specified by the user, as the plurality of first positions, by the extraction processing (refer to FIG. 12, to be described below).

The extraction processing in the third modified example will be explained with reference to FIG. 12. The main processing (refer to FIG. 5) is the same as the above-described embodiment, and an explanation thereof is thus omitted here. The extraction processing in the third modified example is performed at step S5 of the main processing.

First, the CPU 61 reads and acquires the embroidery data from the flash ROM 64 (step S71). From among the plurality of sets of control data included in the acquired embroidery data, the CPU 61 selects the control data one set at a time in ascending order of the index (step S73). The CPU 61 determines whether or not the selected control data is the end data (step S75). When it is determined that the selected control data is not the end data (no at step S75), the CPU 61 determines whether or not the selected control data is the suspension data (step S77). When it is determined that the selected control data is the suspension data (yes at step S77), the CPU 61 returns the processing to step S73. When the selected control data is not the suspension data, the selected control data is the block data. Therefore, the selected control data includes the four sets of vertex data. When it is determined that the selected control data is not the suspension data (no at step S77), the CPU 61 stores, in the table, the coordinates that are indicated by each of the four sets of vertex data included in the block data, as the plurality of first positions, and thus updates the table (step S79). The CPU 61 returns the processing to step S73. When it is determined that the selected control data is the end data (yes at step S75), the CPU 61 ends the extraction processing and returns the processing to the main processing (refer to FIG. 5).

As described above, in the third modified example, the CPU 61 stores, in the table, the coordinates that are indicated by the four sets of vertex data included in the block data, as the plurality of first positions (step S79). In this case, the CPU 61 can extract four of the first positions, for each of the blocks 211, 212, and 213 that form the pattern 210.

The CPU 61 may select at least one of the four sets of vertex data. Then, the CPU 61 may store, in the table, the coordinates that are indicated by the selected vertex data, as one of the plurality of first positions.

Fourth Modified Example

Figure 13:
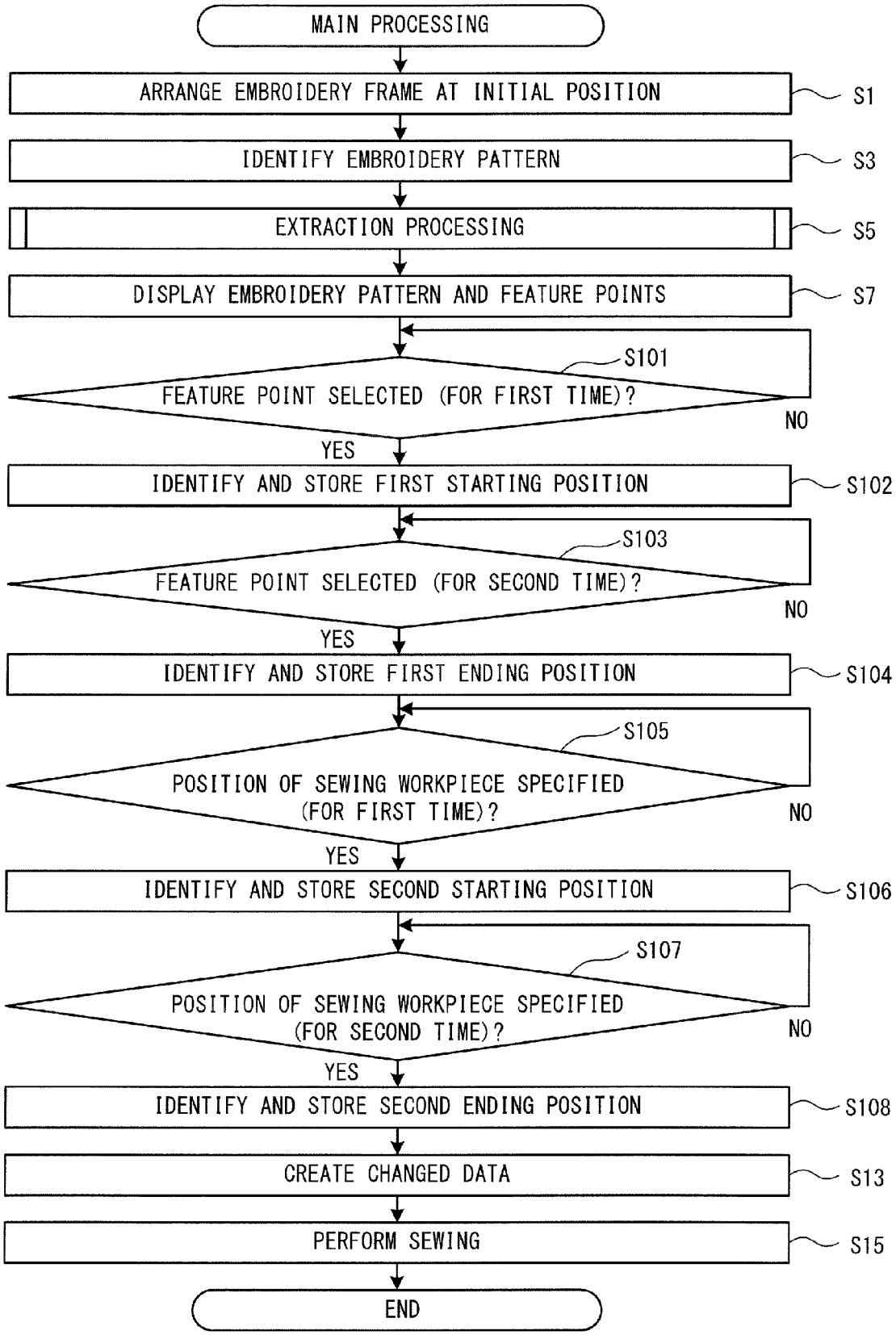
FIG. 13 is a flowchart of main processing of a fourth modified example.

The modified example of the main processing will be explained with reference to FIG. 13. In the fourth modified example of the main processing, the same processing as the main processing shown in FIG. 5 is denoted with the same reference numeral and an explanation thereof is simplified. First, the CPU 61 causes the embroidery frame 53 to be arranged at the initial position (step S1). Next, the CPU 61 causes the LCD 15 to display a screen on which one of a plurality of embroidery patterns can be selected. The user may perform a panel operation to select a desired one of the embroidery patterns. The CPU 61 detects the panel operation and identifies the selected embroidery pattern (step S3). Hereinafter, a specific explanation will be given using an example in which the pattern 200 (refer to FIG. 2) is identified at step S3. Next, the CPU 61 performs the extraction processing (refer to FIGS. 6, 8, 9, and 12) (step S5). The CPU 61 causes the LCD 15 to display an image that shows the pattern 200. Further, the CPU 61 causes the LCD 15 to display the plurality of feature points 206 (refer to FIG. 7) such that the plurality of feature points 206 are superimposed on the displayed pattern 200 (step S7).

The CPU 61 determines whether or not a panel operation that is performed for the first time to select one of the plurality of feature points 206 displayed on the LCD 15 has been detected (step S101). When the CPU 61 determines that the panel operation to select one of the plurality of feature points 206 is not detected (no at step S101), the CPU 61 returns the processing to step S101. When the CPU 61 determines that the panel operation that is performed for the first time to select one of the plurality of feature points 206 is detected (yes at step S101), the CPU 61 identifies the coordinates indicating the first position that corresponds to the selected feature point 206, and stores the coordinates in the RAM 63 (step S102). The CPU 61 determines whether or not the panel operation that is performed for the second time to select one of the plurality of feature points 206 displayed on the LCD 15 is detected (step S103). When the CPU 61 determines that the panel operation to select one of the plurality of feature points 206 is not detected (no at step S103), the CPU 61 returns the processing to step S103. When the CPU 61 determines that the panel operation that is performed for the second time to select one of the plurality of feature points 206 is detected (yes at step S103), the CPU 61 identifies the coordinates indicating the first position that corresponds to the selected feature point 206, and stores the coordinates in the RAM 63 (step S104).

The CPU 61 causes the LCD 15 to display the direction keys and the decision key that are used to move the embroidery frame 53. The user may move the embroidery frame 53 by touching a position that corresponds to the direction key on the touch panel 26. Thus, the user may arrange the position on the sewing workpiece 5 at which the stitches of the pattern 200 are to be sewn, at a position that is vertically below the sewing needle 28 attached to the lower end of the needle bar 29. By touching the position that corresponds to the decision key on the touch panel 26, the user may ascertain the position on the sewing workpiece 5 at which the stitches of the pattern 200 are to be sewn.

When the panel operation on the direction keys is detected, the CPU 61 drives the X axis motor 82 and the Y axis motor 83 in accordance with the detected panel operation, and moves the embroidery frame 53 using the embroidery unit 2. The CPU 61 determines whether or not a panel operation that is performed for the first time on the decision key has been detected via the touch panel 26 (step S105). When it is determined that the panel operation on the decision key is not detected (no at step S105), the CPU 61 returns the processing to step S105. When it is determined that the panel operation that is performed for the first time on the decision key is detected (yes at step S105), the CPU 61 identifies the movement amount in the X direction and the movement amount in the Y direction from the initial position of the embroidery frame 53, based on drive amounts of the X axis motor 82 and the Y axis motor 83 that are driven in accordance with the panel operation on the direction key. The CPU 61 identifies the identified movement amount in the X direction and the identified movement amount in the Y direction, as the coordinates that indicate the second position, and stores the coordinates in the RAM 63 (step S106).

When the CPU 61 detects a panel operation on the direction key after it is determined that the panel operation that is performed for the first time on the decision key is detected, the CPU 61 drives the X axis motor 82 and the Y axis motor 83 in accordance with the panel operation, and continues to move the embroidery frame 53 using the embroidery unit 2. The CPU 61 determines whether or not a panel operation that is performed for the second time on the decision key is detected (step S107). When it is determined that the panel operation on the decision key is not detected (no at step S107), the CPU 61 returns the processing to step S107. When the CPU 61 determines that the panel operation that is performed for the second time on the decision key is detected (yes at step S107), the CPU 61 identifies the movement amount in the X direction and the movement amount in the Y direction from the initial position of the embroidery frame 53, based on drive amounts of the X axis motor 82 and the Y axis motor 83 that are driven in accordance with the panel operation on the direction key. The CPU 61 identifies the identified movement amount in the X direction and the identified movement amount in the Y direction, as the coordinates that indicate the second position, and stores the coordinates in the RAM 63 (step S108). Hereinafter, the first position that is identified for the first time is referred to as a first starting position. The first position that is identified for the second time is referred to as a first ending position. The second position that is identified for the first time is referred to as a second starting position. The second position that is identified for the second time is referred to as a second ending position.

The CPU 61 changes the embroidery data that corresponds to the pattern 200 identified at step S3, based on the first starting position, the first ending position, the second starting position, and the second ending position that are stored in the RAM 63, and creates sixth changed data, which will be described below (step S13). The CPU 61 stores the created sixth changed data in the RAM 63.

Specifically, this is performed as follows. First, the CPU 61 divides the length of a line segment that connects the second starting position and the second ending position by the length of a line segment that connects the first starting position and the first ending position. Thus, the CPU 61 calculates a ratio of the length of the line segment that connects the second starting position and the second ending position with respect to the length of the line segment that connects the first starting position and the first ending position. Next, the CPU 61 calculates an angle when the direction from the first starting position toward the first ending position is rotated to be aligned with the direction from the second starting position toward the second ending position.

Next, the CPU 61 changes the embroidery data to sew the stitches of the pattern 200 to data to sew stitches that represent a pattern obtained by enlarging or contracting the pattern 200 at the calculated ratio. Hereinafter, the pattern 200 that has been enlarged or contracted by the calculated ratio is referred to as a first changed pattern. The data to sew the first changed pattern is referred to as third changed data. Next, the CPU 61 changes the third changed data to data to sew stitches that represent a pattern obtained by rotating the first changed pattern by the calculated angle. Note that the center at the time of rotation is a center point of the first changed pattern. Hereinafter, the first changed pattern that has been rotated by the calculated angle is referred to as a second changed pattern. The data to sew the second changed pattern is referred to as fourth changed data. The fourth changed data is data to sew the second changed pattern such that the center point of the second changed pattern matches the center point 46 of the sewing workpiece 5.

Next, the CPU 61 subtracts the X coordinate of the first starting position from the movement amount in the X direction of the stitch data or the feed data for which the index is smallest among the plurality of sets of control data included in the fourth changed data. Further, the CPU 61 subtracts the Y coordinate of the first starting position from the movement amount in the Y direction of the stitch data or the feed data for which the index is smallest among the plurality of sets of control data included in the fourth changed data. Thus, the fourth changed data is changed to data to sew the second changed pattern such that the first starting position matches the center point 46 of the sewing workpiece 5. Hereinafter, the data to sew the second changed pattern such that the first starting position matches the center point 46 of the sewing workpiece 5 is referred to as fifth changed data.

Next, the CPU 61 subtracts the X coordinate of the second starting position from the movement amount in the X direction of the stitch data or the feed data for which the index is smallest among the plurality of sets of control data included in the fifth changed data. Further, the CPU 61 subtracts the Y coordinate of the second starting position from the movement amount in the Y direction of the stitch data or the feed data for which the index is smallest among the plurality of sets of control data included in the fifth changed data. Thus, the fifth changed data is changed to data to sew stitches that represent the second changed pattern such that the first starting position matches the second starting position. Hereinafter, the data to sew the stitches that represent the second changed pattern such that the first starting position matches the second starting position is referred to as the sixth changed data. The CPU 61 stores the created sixth changed data in the RAM 63.

The second changed pattern is a pattern obtained by enlarging or contracting the pattern 200 at the ratio of the length of the line segment that connects the second starting position and the second ending position with respect to the length of the line segment that connects the first starting position and the first ending position. Further, the second changed pattern is a pattern obtained by rotating the pattern 200 by the angle when the direction from the first starting position toward the first ending position is rotated to be aligned with the direction from the second starting position toward the second ending position. Therefore, when the stitches that represent the second changed pattern are sewn such that the first starting position matches the second starting position, the first ending position corresponding to the changed second changed pattern matches the second ending position. As described above, in order to match the first starting position with the second starting position and to match the first ending position with the second ending position, at step S13, the CPU 61 changes the length between the first starting position and the first ending position that correspond to the pattern 200, and the direction from the first starting position toward the first ending position, and thus creates the sixth changed data.

The CPU 61 acquires the plurality of sets of control data included in the sixth changed data stored in the RAM 63, in the index order, and performs processing corresponding to the type of each set of the control data. Thus, the stitches representing the second changed pattern are sewn on the sewing workpiece 5 (step S15). When the CPU 61 acquires the end data, the stitches representing the embroidery pattern have all been sewn. Therefore, the CPU 61 ends the main processing.

As explained above, the CPU 61 identifies, as the first starting position and the first ending position, the positions of the two feature points selected by the user from among the plurality of feature points 206 (step S102, step S104). The CPU 61 identifies, as the second starting position and the second ending position, different two points on the sewing workpiece 5 selected by the user (step S106, step S108). In order to match the first starting position with the second starting position and to match the first ending position with the second ending position, the CPU 61 changes the length between the first starting position and the first ending position, and the direction from the first starting position toward the first ending position. The CPU 61 creates the sixth changed data by changing the embroidery data to sew the stitches of the pattern 200 in this manner (step S13). When the CPU 61 performs processing based on the sixth changed data, the stitches that represent the pattern obtained by enlarging or contracting and rotating the pattern 200 are sewn on the sewing workpiece 5. Therefore, the user can cause the sewing machine 1 to sew the stitches of the pattern 200 that has been enlarged or contracted and rotated, at desired positions of the sewing workpiece 5. Further, the user can easily perform an operation that causes the sewing machine 1 to sew the stitches of the pattern 200 that has been enlarged or contracted and rotated.

In the above-described embodiment, when the first starting position, the first ending position, the second starting position, and the second ending position are acquired, the CPU 61 may create, based on the embroidery data, changed data to sew the stitches of the pattern 200 that has not been enlarged or contracted and has not been rotated. When the first starting position, the first ending position, the second starting position, and the second ending position are acquired, the CPU 61 may create, based on the embroidery data, changed data to sew the stitches of the pattern 200 that has been rotated but has not been enlarged or contracted.

The method for extracting the plurality of first positions may be set on the sewing machine 1 by a panel operation by the user. The CPU 61 may detect the panel operation and identify the method for extracting the plurality of first positions. The CPU 61 may perform one of the above-described extraction processings (FIGS. 6, 8, 9, and 12) based on the identified method.

Although a detailed explanation is omitted, the embroidery data may include data that indicates a sewing start position, which is a position at which the sewing is started. In this case, the plurality of first positions can include the sewing start position.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing portion configured to perform sewing on a sewing workpiece;

a display configured to display information, the information including an image;

a processor; and a memory configured to store computer-readable instructions, wherein the computer-readable instructions, when executed by the processor, cause the sewing machine to perform processes comprising:

determining a plurality of first positions based on embroidery data, the plurality of first positions indicating a plurality of positions with respect to an embroidery pattern, and the embroidery data identifying positions of a plurality of stitches that represent the embroidery pattern;

causing the display to display an image showing the embroidery pattern and a plurality of feature points superimposed on the image, and the plurality of feature points being marks that respectively indicate the determined plurality of first positions;

identifying one of the plurality of first positions indicated by one of the plurality of feature points displayed on the display;

identifying, as a second position, an arbitrary position on the sewing workpiece;

changing the positions of the plurality of stitches identified by the embroidery data, by aligning the identified one of the plurality of first positions with the identified second position; and causing the sewing portion to sew on the sewing workpiece the plurality of stitches that represent the embroidery pattern, based on the changed positions of the plurality of stitches.

2. The sewing machine according to claim 1, further comprising:

a movement portion configured to move a holding portion, the holding portion being configured to hold the sewing workpiece, wherein in a case where the embroidery data includes movement data, the determining the plurality of first positions includes determining the plurality of first positions based on the movement data, the movement data indicating a movement amount of the holding portion to be moved by the movement portion for each of the stitches in a sewing order.

3. The sewing machine according to claim 1, wherein in a case where the embroidery data includes at least one set of block data, the determining the plurality of first positions includes determining at least one of the plurality of first positions based on the at least one set of block data, each of the at least one set of block data indicating positions of a plurality of vertices of a block, the block being an area in the embroidery pattern.

4. The sewing machine according to claim 2, wherein the movement data includes a plurality of sets of stitch data, each of the plurality of sets of stitch data indicating a movement amount of the holding portion to be moved by the movement portion when the sewing portion sews each of the stitches, and the determining the plurality of first positions includes determining, as each of the plurality of first positions, a position identified based on a value obtained by adding a first movement amount and a second movement amount, every time the sewing order is a particular sequence number, the particular sequence number being a multiple of a predetermined integer, the predetermined integer being an integer greater than one, the first movement amount being an accumulated value of movement amounts indicated by the movement data of the sewing order from the first number to the number immediately preceding the particular sequence number, and the second movement amount being a movement amount indicated by the stitch data of the particular sequence number.

5. The sewing machine according to claim 2, wherein the movement data includes a plurality of sets of stitch data and at least one set of feed data, each of the plurality of sets of stitch data indicating a movement amount of the holding portion to be moved by the movement portion when the sewing portion sews each of the stitches, and each of the at least one set of feed data indicating a movement amount of the holding portion to be moved by the movement portion when the sewing portion does not sew the stitches, and the determining the plurality of first positions includes determining, as at least one of the plurality of first positions, a position identified, for each of the at least one set of feed data, based on a value obtained by adding a first movement amount and a second movement amount, the first movement amount being an accumulated value of movement amounts indicated by the movement data of the sewing order from the first number to the number immediately preceding the sewing order of each of the at least one set of feed data, and the second movement amount being a movement amount indicated by each of the at least one set of feed data.

6. The sewing machine according to claim 3, wherein in a case where the embroidery data includes the at least one set of block data, the determining the plurality of first positions includes determining, as at least one of the plurality of first positions, a position of at least one of a plurality of vertices of each of at least one block indicated by the at least one set of block data.

7. The sewing machine according to claim 2, wherein in a case where the embroidery data includes at least one set of suspension data, the determining the plurality of first positions includes determining, as at least one of the plurality of first positions, a position identified, for each of the at least one set of suspension data, based on an accumulated value of movement amounts indicated by the movement data up to the number immediately preceding the sewing order of each of the at least one set of suspension data, each of the at least one suspension data indicating suspension of a sewing operation.

8. The sewing machine according to claim 1, wherein in a case where the embroidery data includes end data, the determining the plurality of first positions includes determining, as one of the plurality of first positions, a position identified based on the end data, the end data indicating an end of a sewing operation.

9. The sewing machine according to claim 1, wherein the causing the display to display the image and the plurality of feature points superimposed on the image includes causing the display to display the plurality of feature points superimposed on the image in a manner in which each of the plurality of feature points are distinguishable from the image.

10. The sewing machine according to claim 9, wherein the causing the display to display the image and the plurality of feature points superimposed on the image includes causing the display to display each of the plurality of feature points as a design including a first line segment and a second line segment, the first line segment being a line segment that extends in a first direction, the second line segment being a line segment that extends in a second direction, and the second direction being a direction orthogonal to the first direction.

11. The sewing machine according to claim 1, wherein the computer-readable instructions, when executed by the processor, further cause the sewing machine to perform processes comprising:

identifying, from among the determined plurality of first positions, another one of the first positions that is different from the identified one of the plurality of first positions; and identifying, as another second position that is different from the identified second position, another arbitrary position on the sewing workpiece, and the changing the positions of the plurality of stitches identified by the embroidery data includes aligning the first position with the second position and aligning the other one of the first positions with the other second position.

* * * * *